US010586517B2

(12) United States Patent
Dickinson

(10) Patent No.: US 10,586,517 B2
(45) Date of Patent: Mar. 10, 2020

(54) INTONATION SYSTEM FOR STRINGED INSTRUMENTS

(71) Applicant: Jay S. Dickinson, Portland, OR (US)

(72) Inventor: Jay S. Dickinson, Portland, OR (US)

( * ) Notice: Subject to any disclaimer, the term of this patent is extended or adjusted under 35 U.S.C. 154(b) by 0 days.

(21) Appl. No.: 16/213,271

(22) Filed: Dec. 7, 2018

(65) Prior Publication Data

US 2019/0362694 A1 Nov. 28, 2019

Related U.S. Application Data

(63) Continuation-in-part of application No. 15/990,224, filed on May 25, 2018.

(51) Int. Cl.

| | |
|---|---|
| ***G10D 3/04*** | (2020.01) |
| ***G10D 3/14*** | (2020.01) |
| ***G10D 1/08*** | (2006.01) |
| ***G10D 3/06*** | (2020.01) |
| ***G10D 3/12*** | (2020.01) |

(52) U.S. Cl.

CPC ..... *G10D 3/04* (2013.01); *G10D 1/08* (2013.01); *G10D 3/06* (2013.01); *G10D 3/12* (2013.01); *G10D 3/14* (2013.01)

(58) Field of Classification Search

CPC ..... G10D 3/04

See application file for complete search history.

(56) References Cited

U.S. PATENT DOCUMENTS

| | | | | |
|---|---|---|---|---|
| 426,869 | A | 11/1891 | Mendenhall et al. | |
| 490,528 | A | 1/1893 | Wooster | |
| 615,053 | A | 11/1898 | Utt | |
| 1,595,798 | A * | 8/1926 | Marino | G10D 3/04 84/299 |
| 2,491,788 | A * | 12/1949 | Widowson | G10D 3/04 84/298 |
| 2,565,253 | A | 8/1951 | Melita | |
| 2,740,313 | A * | 4/1956 | McCarty | G10D 3/04 84/298 |
| 2,846,915 | A | 8/1958 | Daria | |
| 2,959,085 | A | 11/1960 | Porter | |
| 3,149,526 | A | 9/1964 | Ditzel et al. | |
| 3,178,985 | A | 4/1965 | Jeranson | |
| 3,599,524 | A * | 8/1971 | Jones | G10D 3/12 84/412 |
| 3,605,545 | A | 9/1971 | Rendell | |

(Continued)

OTHER PUBLICATIONS

USPTO, Office Action, dated Aug. 9, 2019, in U.S. Appl. No. 15/990,224.

*Primary Examiner* — Robert W Horn

(74) *Attorney, Agent, or Firm* — Chernoff, Vilhauer, McClung & Stenzel, LLP

(57) ABSTRACT

An intonation system for a stringed musical instrument, a stringed instrument including the intonation system, and a method of setting up a stringed instrument. An instrument such as a guitar includes a bridge having bridge string saddles that can be adjusted separately to raise or lower a single string and to adjust the position of the bridge end of the vibrating length of the string. The instrument also includes an adjustable nut assembly by which to adjust the position of the nut end of each string individually. The structures by which the string saddle positions are adjusted are substantially concealed, largely retaining a conventional appearance of the musical instrument.

23 Claims, 12 Drawing Sheets

(56) References Cited

U.S. PATENT DOCUMENTS

| | | | | | |
|---|---|---|---|---|---|
| 4,031,799 | A | | 6/1977 | Fender | |
| 4,248,126 | A | * | 2/1981 | Lieber | G10D 3/04 84/299 |
| 4,281,576 | A | | 8/1981 | Fender | |
| 4,304,163 | A | | 12/1981 | Siminoff | |
| 4,430,919 | A | * | 2/1984 | Matsui | G10D 3/04 84/299 |
| 4,541,320 | A | | 9/1985 | Sciuto | |
| 4,768,414 | A | | 9/1988 | Wheelwright | |
| 4,867,031 | A | | 9/1989 | Fender | |
| 5,208,410 | A | * | 5/1993 | Foley | G10D 3/04 84/298 |
| 5,404,783 | A | * | 4/1995 | Feiten | G10D 3/04 84/298 |
| 5,410,936 | A | | 5/1995 | Ellsworth et al. | |
| 5,481,956 | A | * | 1/1996 | LoJacono | G10D 3/04 84/314 N |
| 5,689,075 | A | | 11/1997 | Rose | |
| 5,750,910 | A | * | 5/1998 | LoJacono | G10D 3/04 84/314 N |
| 5,986,190 | A | | 11/1999 | Wolff et al. | |
| 6,156,962 | A | | 12/2000 | Poort | |
| 6,433,264 | B1 | | 8/2002 | Gimpel et al. | |
| 6,521,819 | B1 | | 2/2003 | Di Iorio | |
| 6,583,346 | B2 | | 6/2003 | Lojacono | |
| 6,686,523 | B1 | | 2/2004 | Devereaux et al. | |
| 6,706,957 | B1 | | 3/2004 | Merkel | |
| 6,870,083 | B2 | * | 3/2005 | Turner | G10D 3/04 84/298 |
| 7,327,109 | B1 | * | 2/2008 | Hagen | G10D 3/04 318/298 |
| 7,459,617 | B2 | * | 12/2008 | Kim | G10D 3/04 84/298 |
| 7,459,618 | B2 | * | 12/2008 | Kim | G10D 3/04 84/298 |
| 7,563,968 | B2 | | 7/2009 | Medas | |
| 7,638,697 | B2 | * | 12/2009 | Moore | G10D 3/04 84/173 |
| 8,294,012 | B1 | | 10/2012 | Garrick | |
| 8,546,670 | B2 | * | 10/2013 | Finkle | G10D 3/146 84/313 |
| 8,723,007 | B2 | * | 5/2014 | Tracy | G10D 3/04 84/307 |
| 8,748,718 | B2 | | 6/2014 | Pederson | |
| 9,449,587 | B2 | | 9/2016 | Babicz, Sr. | |
| 9,799,310 | B2 | | 10/2017 | Damaschke et al. | |
| 10,163,424 | B2 | | 12/2018 | Colas | |
| 2004/0074367 | A1 | * | 4/2004 | Devereaux | G10D 3/04 84/299 |
| 2006/0042449 | A1 | * | 3/2006 | Chang | G10D 3/04 84/298 |
| 2010/0005944 | A1 | | 1/2010 | Eliasson et al. | |
| 2010/0319514 | A1 | | 12/2010 | Aires | |
| 2017/0032768 | A1 | * | 2/2017 | Dunwoodie | G10D 3/12 |
| 2019/0362693 | A1 | * | 11/2019 | Dickinson | G10D 3/06 |
| 2019/0362694 | A1 | * | 11/2019 | Dickinson | G10D 3/12 |

* cited by examiner

FIG. 21
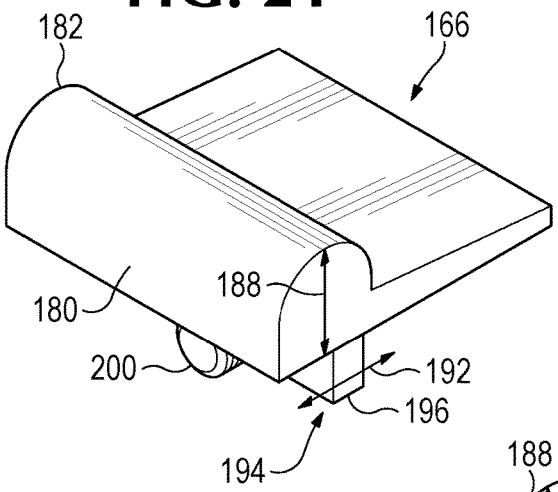
FIG. 22
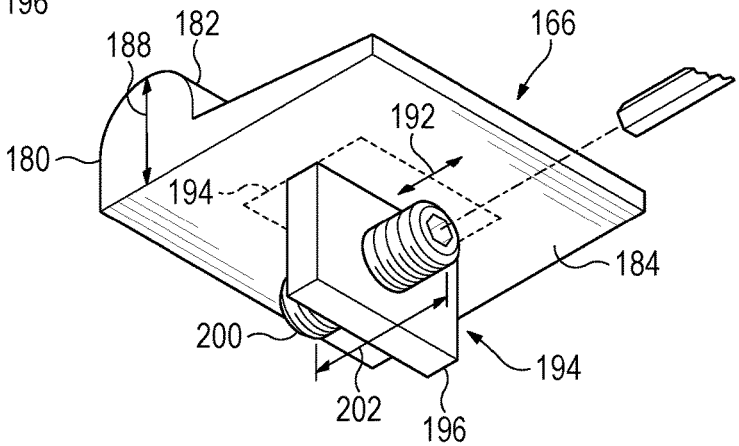
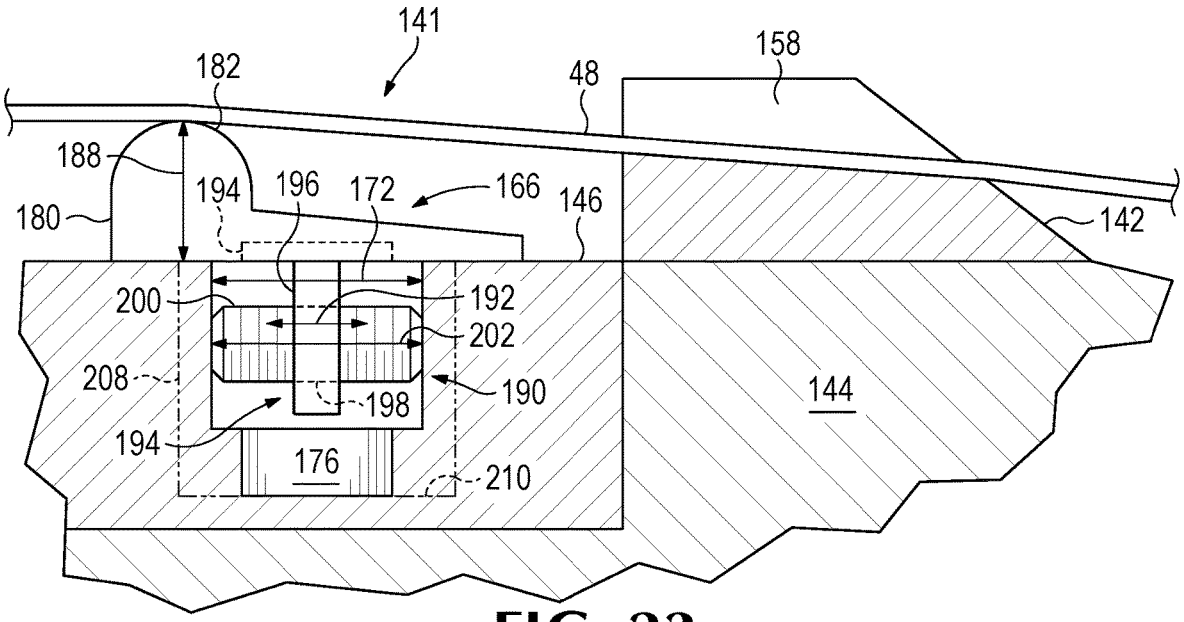
FIG. 23

INTONATION SYSTEM FOR STRINGED INSTRUMENTS

CROSS-REFERENCE TO RELATED APPLICATIONS

This patent application is a continuation-in-part of U.S. patent application Ser. No. 15/990,224, filed May 25, 2018.

BACKGROUND OF THE INVENTION

The present invention relates to stringed musical instruments having finger boards including frets, and relates particularly to setting up such a musical instrument by adjusting the positions of the open strings in order to improve the ability of the strings of the instrument to vibrate at the intended frequencies as accurately as practical throughout the entire designed tonal range of each string, and to have the strings located so as to be as comfortably playable as possible for a particular musician.

Stringed instruments such as lutes, guitars, banjos, and mandolins have several strings extending parallel with one another and held in tension, extending between two fixed supports, a nut at an outer end of a neck and a bridge located on a body from which the neck extends. The distance between the nut and the bridge is the open length of a string and thus establishes its fundamental tone when the string is held in tension. A fingerboard including frets is included in the neck and may extend over the body. A string can be made to sound a note higher than its fundamental tone by fretting the string, that is, by pressing the string against the fingerboard adjacent to one of the frets.

Several factors contribute to determine whether a fretted string will produce the desired note. The material of which the string is made, the action height of the instrument (the distance between an open string and the frets), the thickness, or gauge, of the string, the tension of the string when it is tuned to its intended fundamental tone and the length of the open string, all affect the frequency at which the string vibrates when the string is pressed against a fret located on the fingerboard. A musician may have a preference for particular types of strings, for a particular spacing between strings, or for the location of an outermost one of the strings with respect to a side of the fingerboard. Even the structure of the body of the instrument has an effect, since the top of the body is effectively a sound board that vibrates and thus may make a string vibrate as if it were a little longer than the actual distance between the nut and the bridge.

While various adjustable guitar bridges and nuts are known, they usually present a technical or mechanical appearance that detracts from the traditional appearance of a guitar or other acoustic stringed instrument. What is desired, then, is a stringed instrument having the capacity for its intonation to be optimized string-by-string, yet having a traditional, non-mechanical appearance, and a method of setting up such an instrument according to preferences of a particular musician.

SUMMARY OF THE INVENTION

A stringed instrument, in particular a guitar, as disclosed herein incorporates components by which a selected set of strings can be located with respect to a fingerboard and with respect to one another according to a musician's preferences and includes a system of mechanisms for intonation that can be used to adjust each string of the instrument, at the nut and at the bridge, so that the resulting note produced by the string will be as close as practical to the intended note when the string is fretted at any of the available frets.

In one embodiment of the system for intonation disclosed herein, a bridge mounted on the body of an instrument includes a separate string saddle, one for each string, carried on a base member of the bridge. Each of the string saddles is separately movable with respect to the base member of the bridge, through an available range of possible positions in the direction toward or away from the nut.

In one embodiment of the adjustable bridge disclosed herein a frictional member helps to prevent movement of a string saddle with respect to the base member of the bridge when a string supported on that string saddle is in tension.

In one embodiment of the bridge disclosed herein a string saddle is mated with a saddle base member held in a receptacle defined in the base member of the bridge, and the string saddle is readily movable with respect to the saddle base member by use of an adjustment tool.

In one embodiment of the bridge disclosed herein a shim may be placed under a saddle base member to adjust the height of the related string saddle with respect to the base member of the bridge, and thus with respect to the fingerboard.

In one embodiment of the bridge disclosed herein, a string saddle includes a spring pressing against a saddle base member so as to move the string saddle slightly, when a related string is not in tension, to a position in which the string saddle is in contact against an adjacent surface with sufficient pressure to prevent the string saddle from moving without intentionally being moved.

In one embodiment of the intonation system disclosed herein a nut assembly includes a separate adjustable nut saddle for each string, and each of the nut saddles is held in a respective nut saddle cavity.

In one embodiment of the adjustable nut assembly disclosed herein each nut saddle includes an adjustment mechanism by which the nut saddle may be made to fit in its respective nut saddle cavity at a selected position of adjustment in a direction toward or away from the bridge of the stringed instrument.

In accordance with another aspect of the invention adjustments of string height, length, and spacing can all be accomplished at the outer, or nut, end of the fingerboard.

In accordance with a method of setting up a musical instrument several items that contribute to accurate intonation of each string, including string spacing, action height, and fundamental length of each string, are adjusted individually, so that a string fretted at any of the frets included in a fingerboard of the instrument will sound with as accurate frequencies as practical.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

FIG. 21 is an isometric view, at an enlarged scale, of one of the adjustable string bearers shown in FIGS. 19 and 20.

FIG. 22 is an isometric view of the adjustable string bearer shown in FIG. 21, taken from an opposite point of view.

FIG. 23 is a sectional view similar to FIG. 18, taken along line 23-23 of FIG. 20, at an enlarged scale, showing the outer end of a fingerboard and the arrangement for adjusting the positions of the individual string bearers.

DETAILED DESCRIPTION OF PREFERRED EMBODIMENTS

Figure 1:
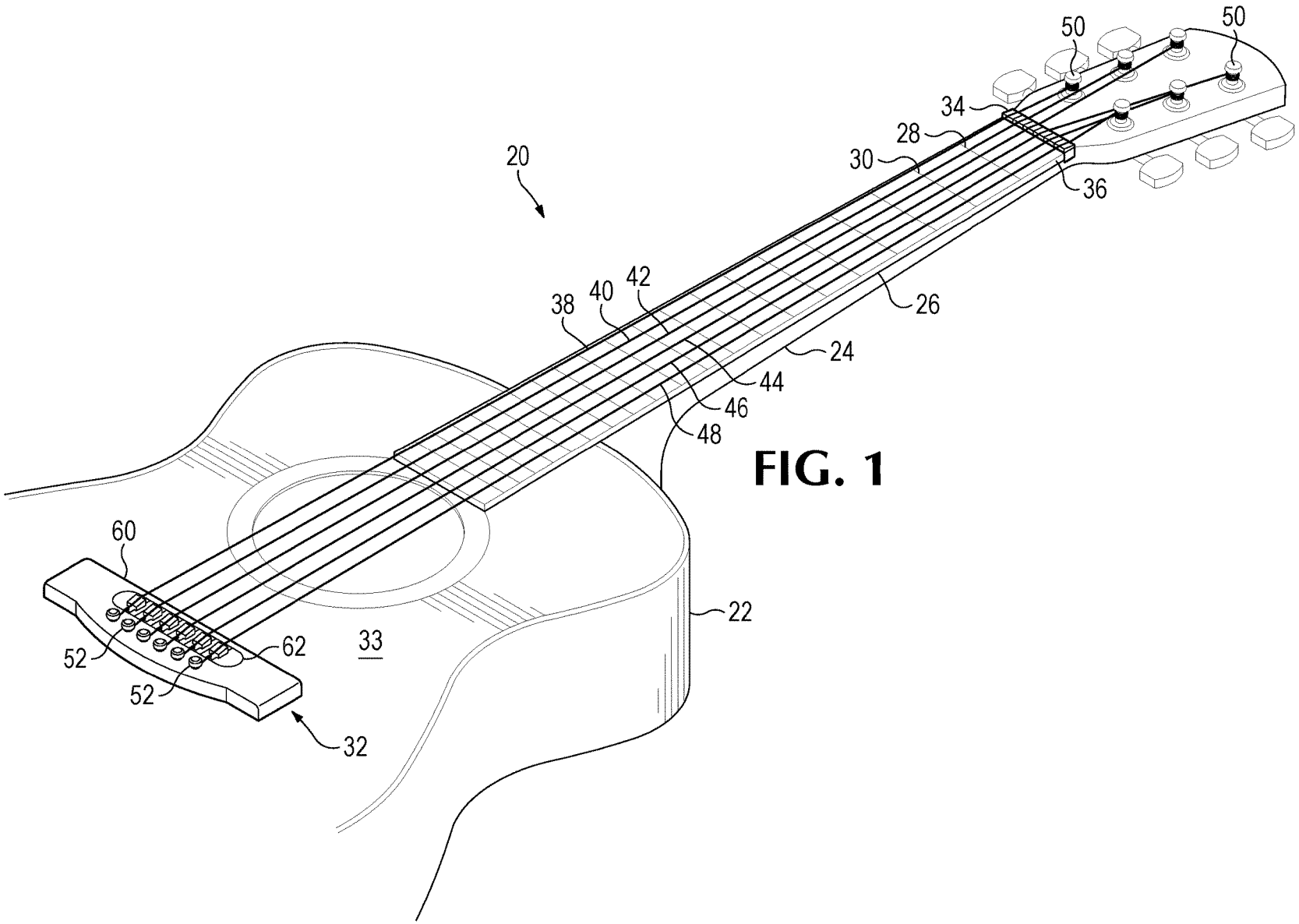
FIG. 1 is an isometric view of an acoustic guitar including an intonation system embodying aspects of the present invention.
Figure 2:
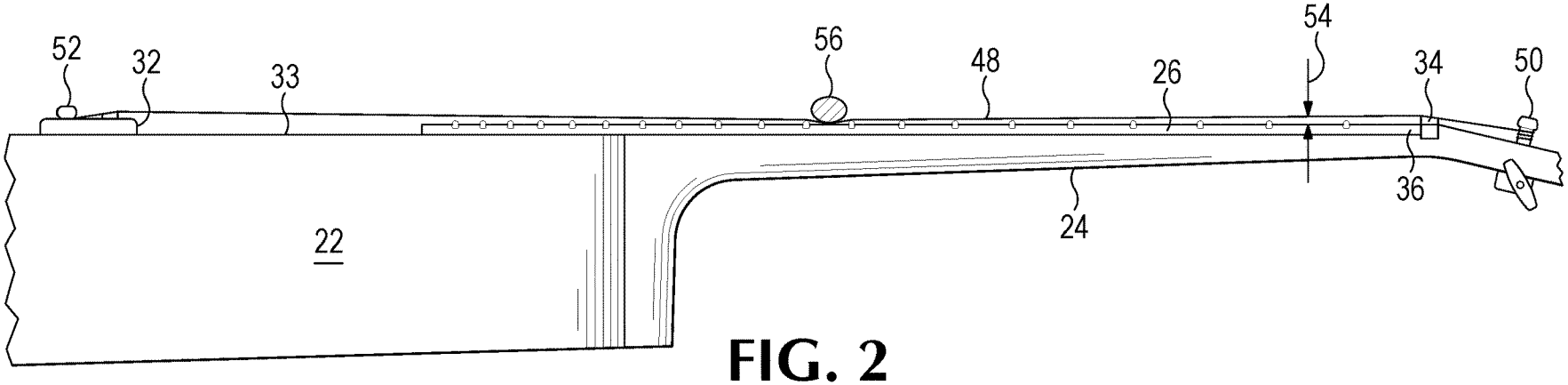
FIG. 2 is a side elevational view of the guitar shown in FIG. 1, showing one of the strings fretted near the middle of its length.
Figure 3:
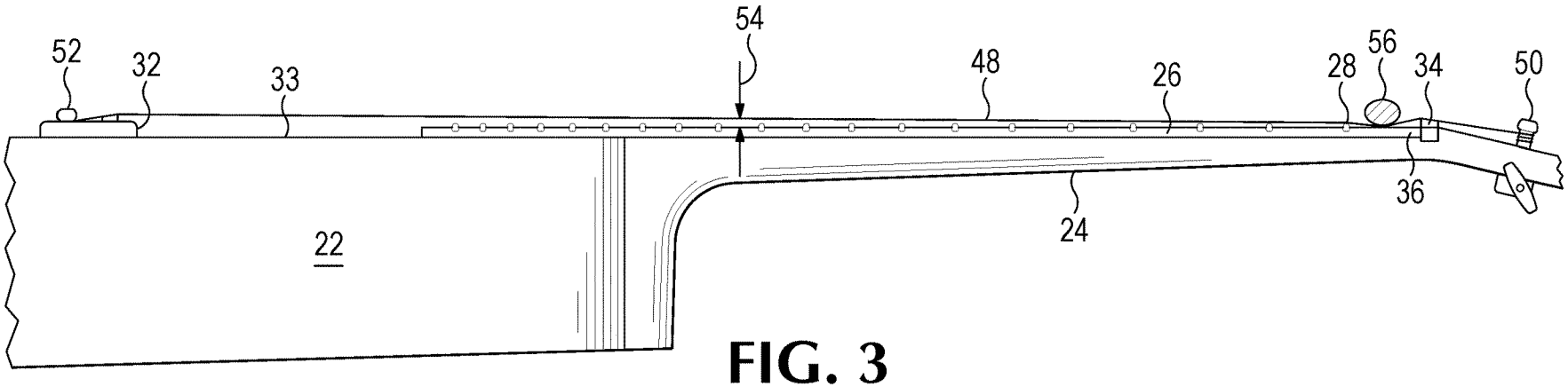
FIG. 3 is a side elevational view of the guitar shown in FIGS. 1 and 2, showing one of the strings fretted at the first fret, adjacent the nut.

Referring now to FIGS. 1-3 of the drawings that form a part of the disclosure herein, a guitar 20 including the intonation system disclosed herein has a body 22, sometimes called a tone body, and a neck 24 attached to and extending away from the body 22. The neck 24 includes a fingerboard 26, and frets 28, 30, etc., are mounted in the fingerboard 26, extending transversely across its width at positions that are determined mathematically in a well-known manner. There is a bridge assembly 32 mounted on the top, or soundboard, 33 of the body 22 and an adjustable nut 34 is located at the outer end 36 of the fingerboard 26. The neck 24 may be attached to the body 22 in a well-known manner in order to permit adjustment of the angle 37 at which the neck 24 extends away from the body 22, as may be seen best in FIGS. 2 and 3.

Six strings 38, 40, 42, 44, 46, and 48 extend from the bridge 32 along the fingerboard 26 and over the nut 34 to respective tuning pegs 50, shown associated with respective tuning machines. The bridge end of each string 38, etc. is secured to the bridge 32 in the normal fashion in which the bridge end of the string extends down through a hole in the bridge 32 and is secured by a respective pin 52. Each string 38, 40, etc., extends from the bridge 32 along the fingerboard 26 and over the nut 34, and its other, or free, end is wrapped around a respective one of the tuning pegs 50, which places the string into tension to tune the guitar 20.

When the strings 38, 40, etc., are in tension they are supported by and extend between the bridge 32 and the nut 34 with a certain amount of spacing 54, called the action height, between each string and the fingerboard 26. The spacing or action height 54 may be changed by adjustment of the angle 37, as well as by other adjustments that will be described hereinbelow, and normally is designed to give each string room to vibrate without striking any of the frets, 28, 30, etc.

Each string 38, 40, etc., when it is open, so its entire length between the bridge 32 and the nut 34 is free to vibrate, has a fundamental frequency, and an appropriate amount of tension establishes a desired fundamental frequency for each string 38, 40, etc., when the guitar 20 is tuned. As shown in FIGS. 2 and 3, a note higher than the fundamental frequency can be produced by the player using a finger 56 to press string 48, for example, against the fingerboard 26, so that the string 48 is forced into firm contact with the fret 30, the fret closest to the finger 56 and between the finger 56 and the bridge 32. The effective length of the string 48 is then the distance between the fret 30 and the bridge 32. At least a minimum action height 54 is required to keep a vibrating string from undesirably hitting the frets and causing an annoying buzzing sound, but greater action height requires greater effort to force the string against a fret. The action height 54 may be made to be the same along the length of the fingerboard by adjusting the angle 37 at which the neck 24 extends away from the body 22, as is well known.

When a string is pressed down against the fingerboard 26 the string is necessarily elongated elastically at least a small amount, and the amount of tension in the string is increased slightly accordingly. In designing the fingerboard of a musical instrument this elongation and increase of tension in the string are considered in determining the proper placement of each fret 28, 30, etc., but as mentioned above, the characteristics of a particular string will result in more or less accuracy of the resulting vibrational frequency, or tone, of the fretted string. When a string is fretted near the middle of its length the amount of elongation required to effectively force the string against a fret may be different from the amount of elongation and force required to hold the string against the first fret 28, as shown in FIG. 3.

Since the locations of the several frets 28, 30, etc. along the fingerboard are fixed, if the vibrating frequency of a fretted string is too high, and if the degree of error by which that string's frequency is too high increases with fretting the string closer and closer to the bridge, accuracy of the tone produced by the string can be improved to have a similar amount of error at each fret, by effectively lengthening the string at its bridge end, using the adjustable bridge assembly 32.

Figure 4:
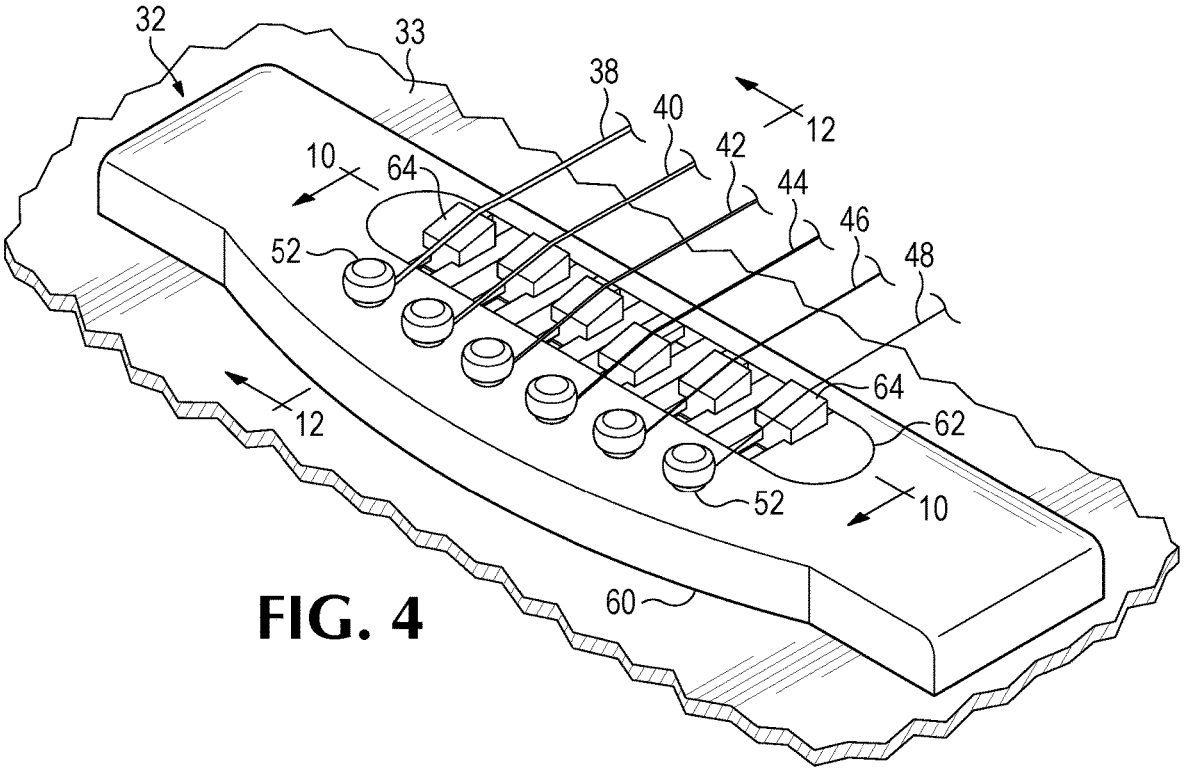
FIG. 4 is an isometric view of the bridge and a surrounding portion of the top of the guitar in FIG. 1.

Conversely, if the vibrating frequency of a fretted string is too low, and if the degree of frequency error by which the frequency of the fretted string is too low increases with fretting the string closer and closer to the bridge, accuracy of the tone produced by the string can be improved, to be more consistent over the several frets, by shortening the string at its bridge end, using the adjustable bridge assembly 32. That is, the adjustable bridge assembly 32, shown in FIG. 4, can be used to lengthen or shorten each string at its bridge end, as will be explained in greater detail below.

When the frets 28, 30, etc. are located correctly on the fingerboard 26, with the appropriate distances between the frets, adjustment of the length of one of the strings 38, 40, etc. at the bridge assembly 32 may result in the string sounding too high by the same amount relative to its fundamental frequency at each of the frets along the fingerboard 26. That is, one of the strings may be in tune when it is open, but may sound too high in frequency by a small amount at each fret, including the first fret 28, the fret closest to the nut 34. Alternatively, where the length of the string has been adjusted at its bridge end to be in tune when it is open, the string may sound too low in frequency by a similar small amount at each fret, including the first fret 28.

Figure 5:
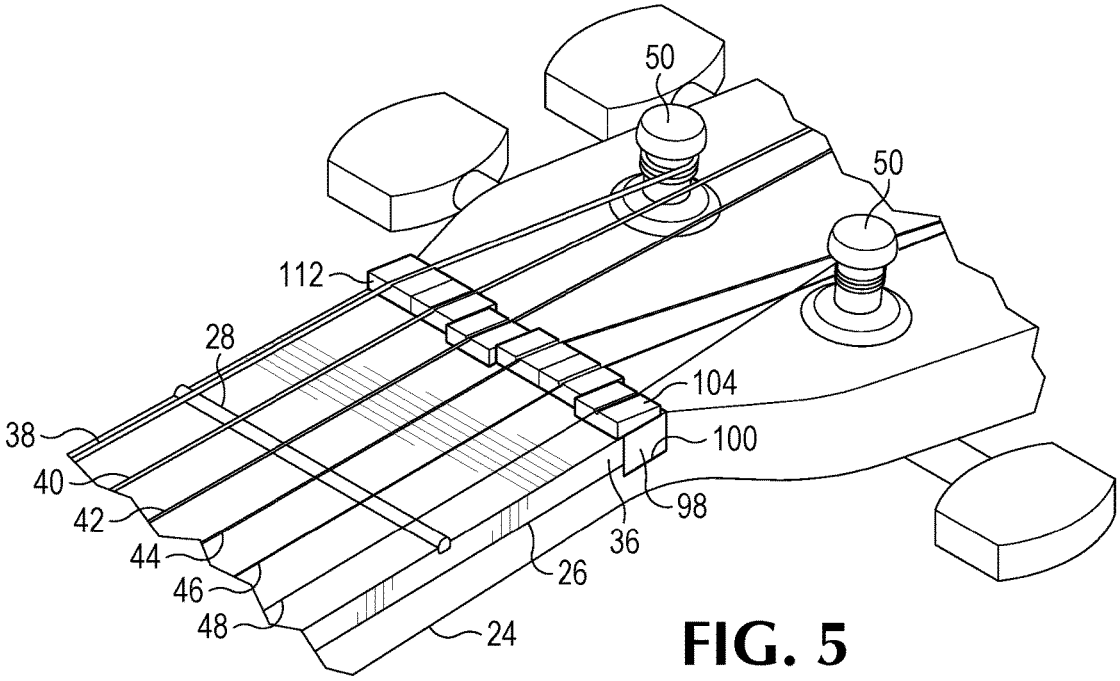
FIG. 5 is an isometric view of an outer end portion of the neck of the guitar shown in FIG. 1, showing the nut and portions of the strings of the guitar near the nut.
Figure 6:
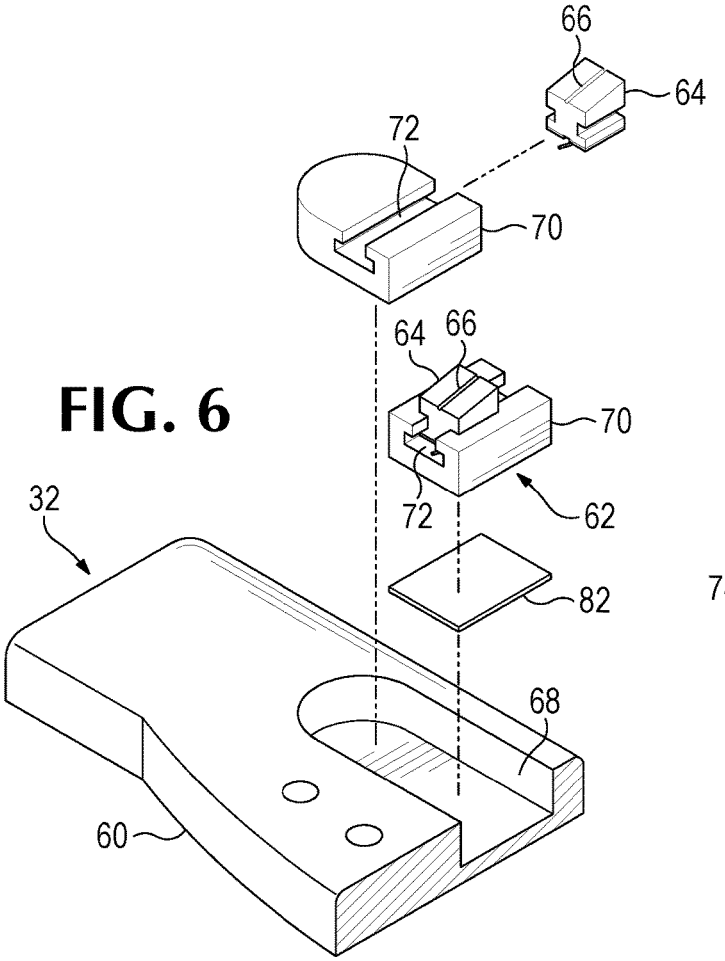
FIG. 6 is an exploded isometric view of a portion of the bridge shown in FIG. 4.

If a string that is in tune at its fundamental frequency produces a note that is too low when fretted on the first fret 28, the error can be corrected by adjustment of the adjustable nut 34, shown in FIG. 5, to effectively shorten the string at the nut end. Conversely, if the string sounds too high when fretted at the first fret 28, the error can be corrected by adjustment of the adjustable nut 34 to effectively lengthen the string at its nut end, as will be explained In greater detail below.

Referring to FIGS. 4 and 6-13, the bridge assembly 32 includes a bridge base member 60 which. may be of hardwood and a plurality of bridge string saddle assemblies 62. Each bridge string saddle assembly 62 includes a bridge string saddle element 64 that may be of a hard material such as bone, defining a string-receiving groove 66 in which one of the strings rests and from which the one of the strings extends away from the bridge base member 60 toward the nut 34.

The bridge base member 60 defines a saddle receptacle 68, a channel-like cavity defined in the bridge base member 60. Separate bridge string saddle assemblies 62 for each of the strings 38, 40, etc., are held closely alongside one another in the saddle receptacle 68. Each bridge string saddle assembly 62 includes a saddle base member 70 that may be of hardwood and that defines a guide channel 72 with which a respective one of the bridge string saddle elements 64 is mated. The guide channel 72 defined in each saddle base member 70 is oriented parallel with the direction between the bridge assembly 32 and the nut 34, thus along the length of the respective one of the strings.

In the embodiment of the bridge assembly 32 shown herein, the guide channel 72 defined in each bridge saddle base member 70 as shown herein is a T-slot, and the associated bridge string saddle element 64 includes a lower portion 74 mated in the T-slot 72. The lower portion 74 of the bridge string saddle element 64 includes a downwardly extending web 76. A pair of oppositely-oriented flanges 78 extend laterally from respective sides of the web 76 and are disposed slidably within respective side grooves 80 of the T-slot the saddle base member 70, with a certain amount of clearance, as will become apparent.

Figure 7:
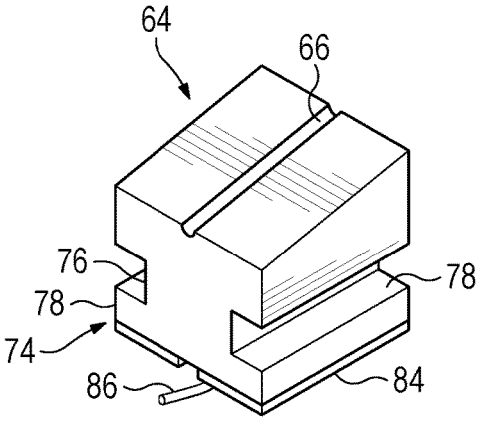
FIG. 7 is an isometric view of a bridge string saddle element such as one shown in FIG. 6, taken in the same direction as FIG. 6, but at an enlarged scale.
Figure 7A:
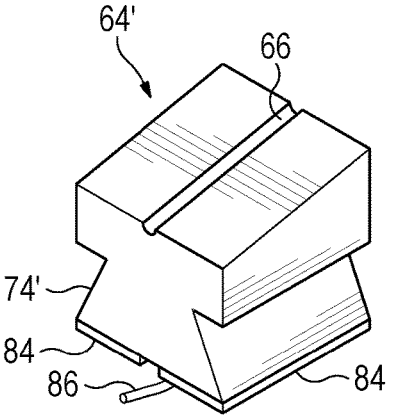
FIG. 7A is a view similar to FIG. 7, showing an alternative form of a bridge string saddle element.

Alternatively, as shown in FIGS. 7 A and 9A, instead of a T-slot in a bridge saddle base member 70' a guide channel 72' may be in the form of a dovetail slot and a lower portion 74' of a bridge string saddle element 64' may have a corresponding dovetail shape. Other shapes may also be acceptable, as will be understood, so long as the resulting bridge string saddle assembly can function as will be described presently.

A respective shim 82 of generally hard material such as a thin piece of hardwood may be located beneath one or more of the bridge saddle base members 70 in the receptacle 68 defined in the bridge base member 60, to adjust the height of the respective string saddle element with respect to the top 33 of the body 22. This may be desirable to provide a desired action height 54 for a string, for example to accommodate an arched contour of the fingerboard 26 or the way a particular string vibrates. The preferred action height 54 for a particular string may, for a particular musician, depend upon the manner in which the instrument is intended to be played, and may also depend upon the material and size of the string.

Figure 8:
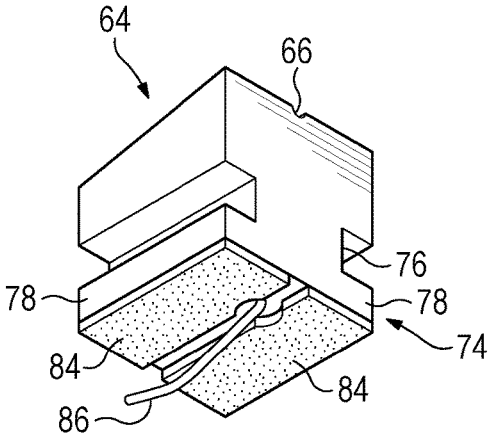
FIG. 8 is an isometric view of the string saddle shown in FIG. 7, taken from an opposite point of view.
Figure 9:
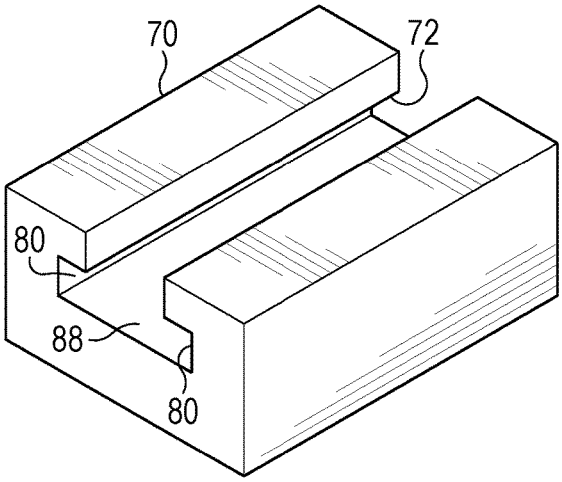
FIG. 9 is an isometric view of a saddle base member such as one shown in FIG. 6, at an enlarged scale.
Figure 9A:
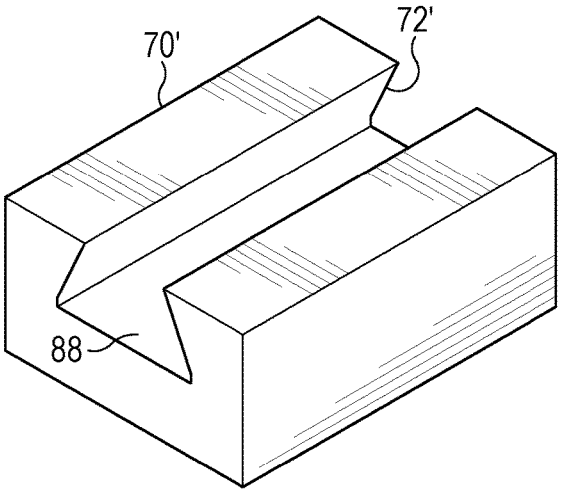
FIG. 9A is a view similar to FIG. 9, showing a saddle base member of an alternative form.

As shown best in FIG. 8, the bottom 83 of each bridge string saddle element 64 may have a pair of small pieces of frictional material 84 such as fine-grit sandpaper glued in place with the frictional surface facing downward toward a bottom surface 88 of the T-slot 72 in which the bridge string saddle element 64 is mated.

Figure 10:
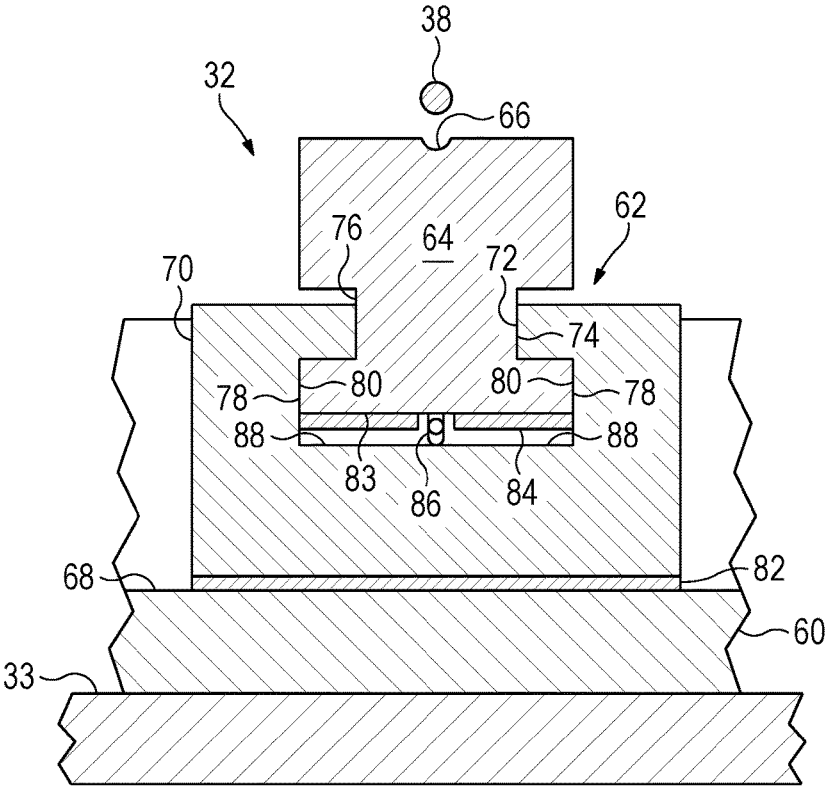
FIG. 10 is a sectional view taken along line 10-10 in FIG. 4, at an enlarged scale.

Between the pieces of frictional material 84 there may be a small spring 86, for example, a small piece of spring wire with an end fastened in the lower portion 74 of the bridge string saddle element 64, and with the wire extending along the bottom of the bridge string saddle element, at a small angle to the bottom of the bridge string saddle element and parallel with the guide channel 72 in which the bridge string saddle element 64 is located. The spring 86 thus protrudes downward a small distance beneath the frictional surface of the small pieces of sandpaper 84, as may be seen in FIGS. 7, 8, 10, and 12. By pressing against the bottom surface 88 of the guide channel 72 in the bridge saddle base member 70 the spring 86 urges the bridge string saddle element 64 upward toward the position shown in FIG. 10. The spring 86 should be strong enough so that if the associated string 38 or 40, etc., extending along the respective bridge string saddle element 64 is not in tension, as may be seen exaggerated in FIG. 10 with exaggerated clearance for better understanding, the spring 86 can raise the bridge string saddle element 64 slightly within the T-slot 72 to release the frictional members 84 from effective engagement against the bottom surface 88 of the T-slot guide channel 72 and press the flanges 78 against the upper interior surfaces of the side grooves 80 of the T-slot guide channel 72, as shown in FIG. 10. The spring 86 should press the flanges 78 of the string saddle element firmly enough against the upper interior surfaces of the side grooves 80 of the T-slot so that the bridge string saddle element 64 is not free to simply slide along within the guide channel 72 because of its own weight when tension in the associated guitar string 38, etc., is relaxed as shown in FIG. 10.

Figure 11:
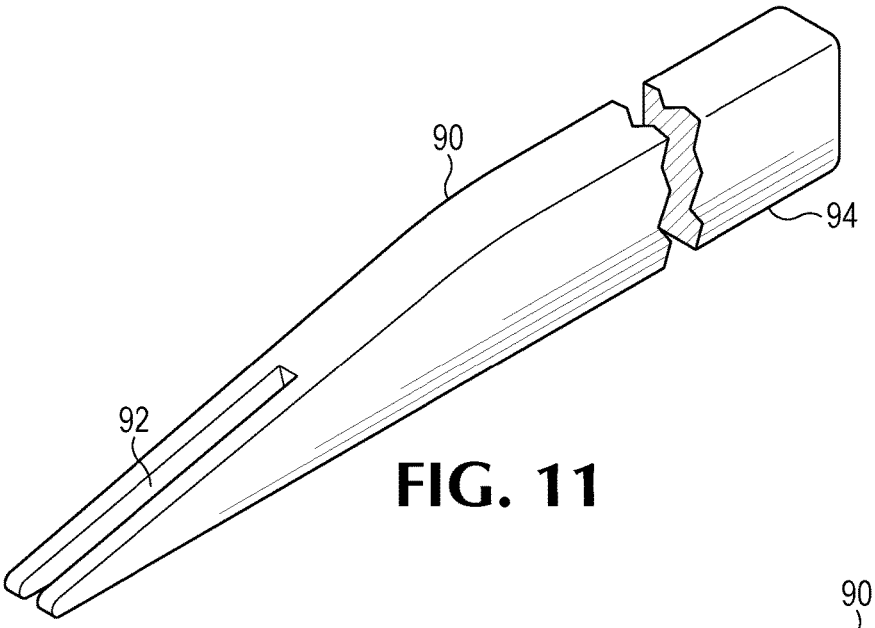
FIG. 11 is an isometric view of a portion of a tool for use in adjusting the position of a string saddle included in the bridge shown in FIG. 4.
Figure 12:
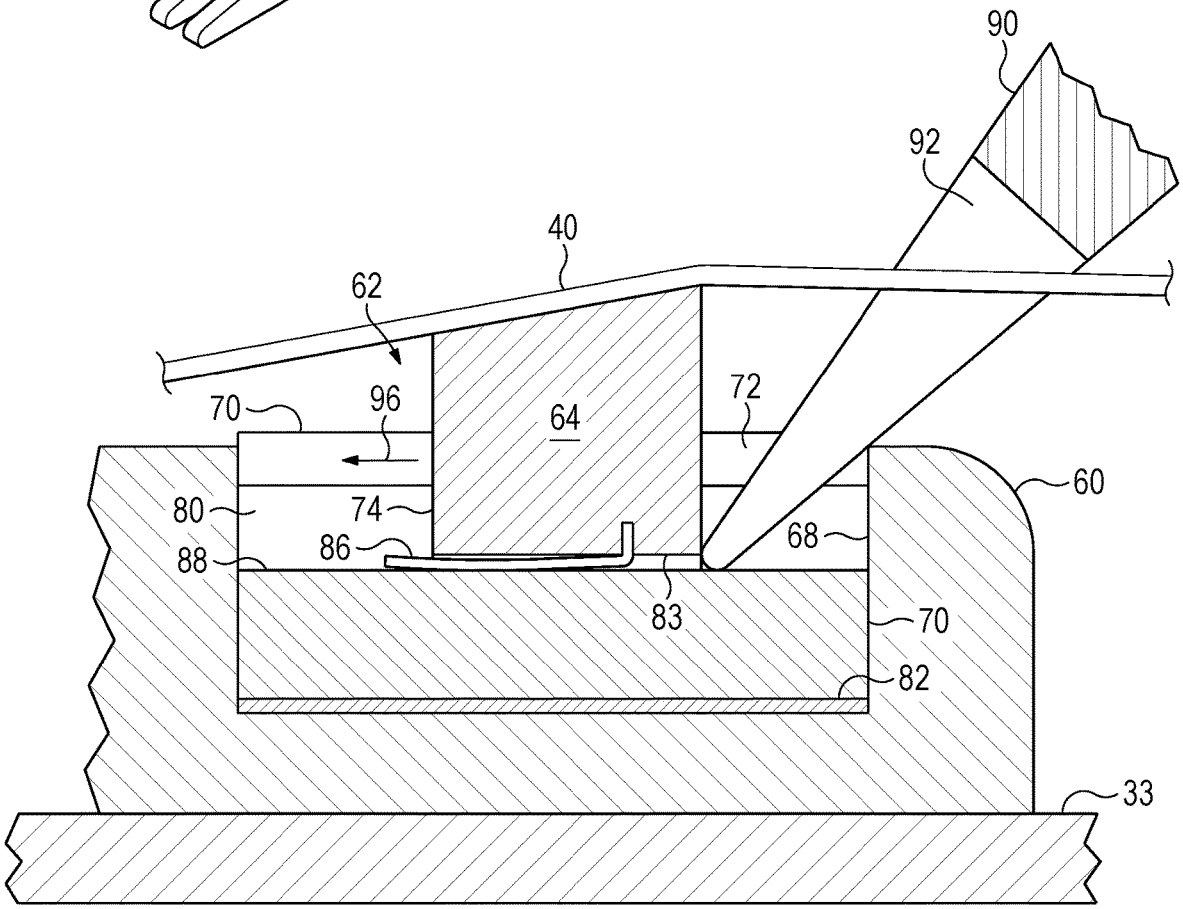
FIG. 12 is a sectional view taken along line 12-12 in FIG. 4, at an enlarged scale, illustrating the manner of adjusting the bridge using the tool shown in FIG. 11.
Figure 13:
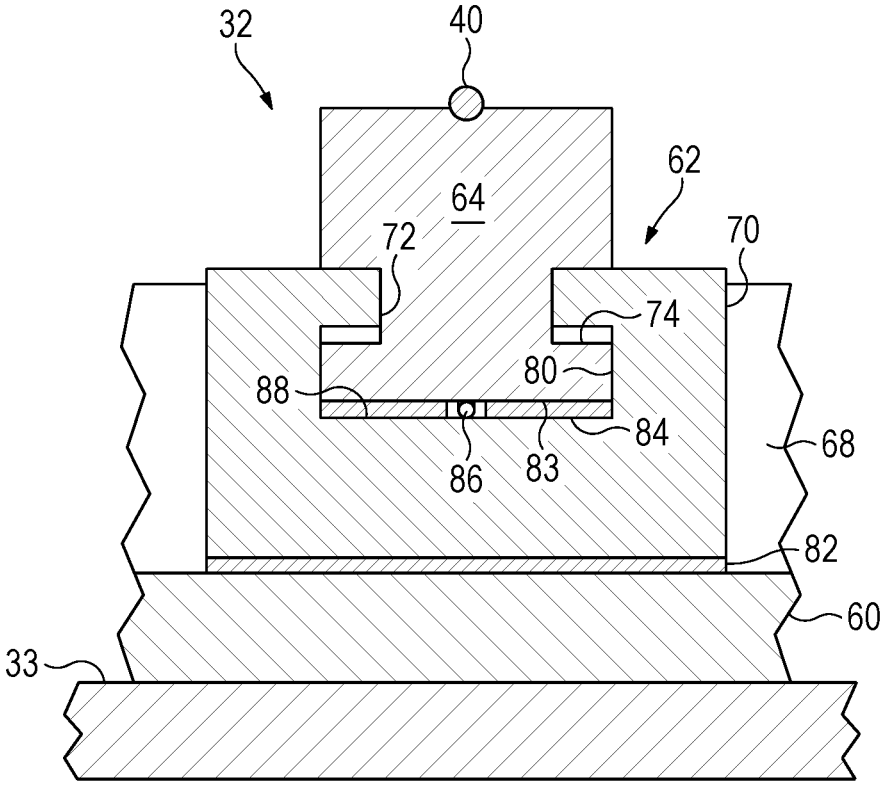
FIG. 13 is a view similar to FIG. 10, illustrating a portion of the bridge in the condition resulting when a string supported by the string saddle is in tension.

Referring now to FIGS. 11 and 12, a bridge string saddle adjustment tool 90 has a narrow tip defining a slot 92 large enough to receive any of the strings, and has a handle 94 of a desired length for convenient use. As illustrated in FIG. 12 the adjustment tool 90 is used as a lever to urge a selected one of the bridge string saddle elements 64 within the respective guide channel 72 in a desired direction with respect to the bridge base member 60 when the associated string is loosened enough so that the spring 86 is at least reducing the amount of pressure of the frictional material 84 against the bottom surface 88 of the guide channel 72, and the bridge string saddle element 64 may thus be in the position shown in FIG. 10. Movement of the bridge string saddle element 64 in the direction indicated by the arrow 96 shown in FIG. 12 will extend the length of the associated string at the bridge end.

Once the position of the bridge string saddle element 64 has been adjusted by a desired amount, tension may be restored in the associated string to bring it into tune. When the string 38, etc., is placed in tension the bridge string saddle element 64 is pressed downward within the T-slot guide channel 72 to the position shown in FIG. 13. That is, tension in the string overcomes the force of the spring 86 and presses the bridge string saddle element 64 down so that the frictional material 84 engages the bottom surface 88 of the guide channel 72 in the bridge saddle base member 70. The small movements of the string within and along the groove 66 in the bridge string saddle element 64 during subsequent tuning of the instrument will be insufficient to move the bridge string saddle element 64 with respect to the bridge saddle base member 70, and the effective length of the string at the bridge end will not be affected by tuning the instrument.

As shown in FIGS. 5 and 14-18, the adjustable nut 34 allows the open length of each string 38, 40, 42, etc., to be adjusted individually at the nut end of the particular string, as may be desired for separately optimizing the intonation of each string of the instrument. A nut base member 98 is mounted in a transversely extending channel 100 in the neck 24, at the outer end 36 of the fingerboard 26, where a conventional non-adjustable nut would ordinarily be located. The nut base member 98 may preferably define several separate nut saddle receptacles 102 in the form of cavities, with a separate nut saddle receptacle 102 provided to receive a respective individual nut saddle 104 to support each string 38 or 40, etc., and hold it in its respective position with respect to the width of the fingerboard 26. Each such nut saddle receptacle 102 has a respective length 106, parallel with the length of the neck 24, and a width 108, in a direction across the length of the neck 24.

Figure 14:
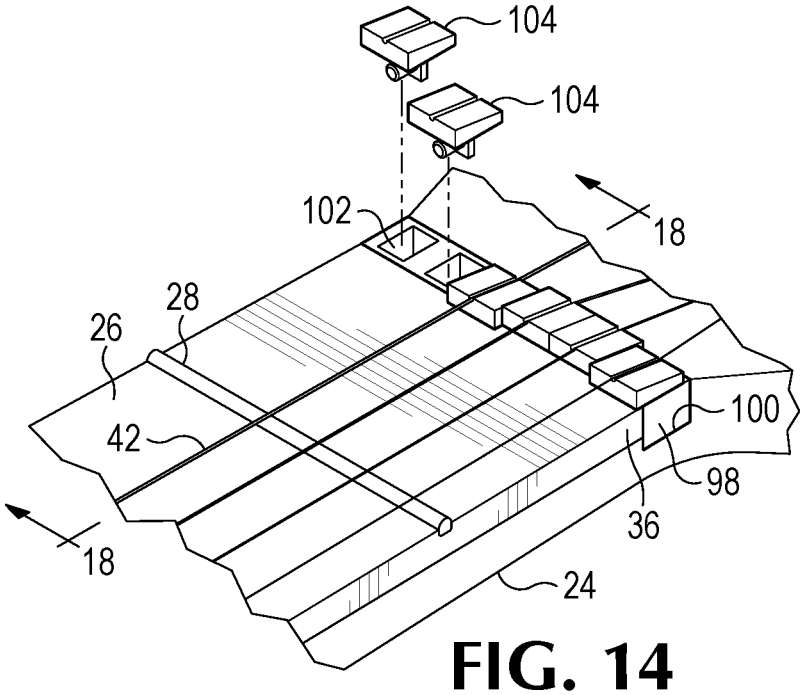
FIG. 14 is an isometric view of an outer end portion of the neck of the guitar shown in FIG. 1, showing the adjustable nut and a pair of adjustable nut saddles exploded away from the nut.
Figure 15:
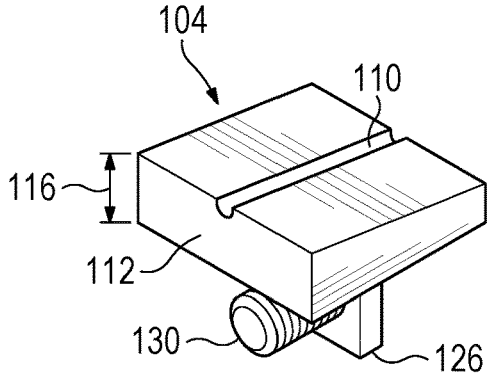
FIG. 15 is an isometric view, at an enlarged scale, of one of the adjustable nut saddles shown in FIG. 14.

A string-receiving groove 110 extends along the top of each nut saddle 104, aligned with the length of the fingerboard and the strings, as may be seen in FIGS. 14 and 15. Each nut saddle 104 may be tapered in height in the direction in which the string-receiving groove 110 extends, with the fingerboard side 112 of the nut saddle 104, located closer to the fingerboard 26 and the bridge 32, being highest. A string 38 or 40, etc., in tension and located in the string receiving groove 110 thus presses firmly against the nut saddle 104 at the fingerboard side 112 of the nut saddle 104, which defines the nut end of the open string length that is available to be tuned to its intended fundamental frequency.

Figure 16:
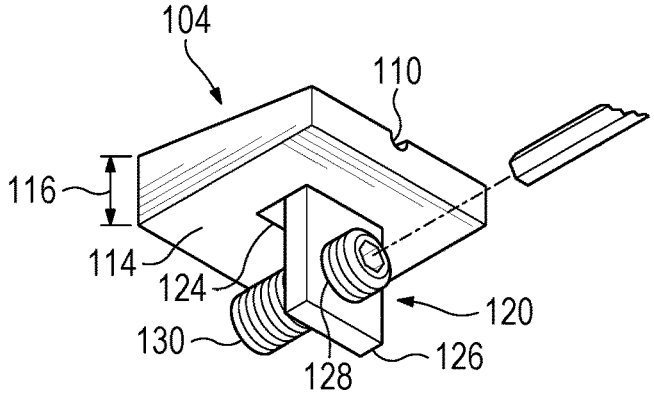
FIG. 16 is an isometric view of the adjustable nut saddle shown in FIG. 15, taken from an opposite point of view.
Figure 17:
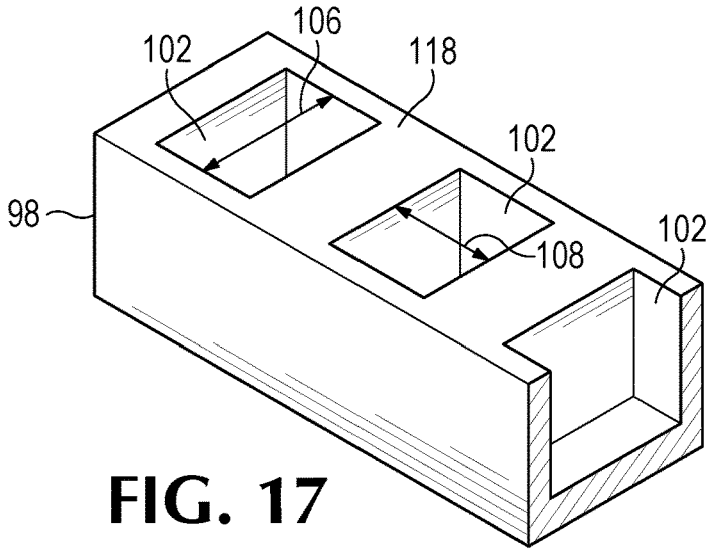
FIG. 17 is an isometric view, at an enlarged scale, of a portion of a base member of the adjustable nut shown in FIG. 14.

Each nut saddle 104 has a bottom surface 114, seen in FIG. 16, that rests against the generally planar top surface 116 of the nut base member 98 that surrounds the nut saddle receptacles 102. Depending upon the position of the nut saddle 104, as will be explained, the bottom surface 114 may also rest on the top of the fingerboard 26. The height 116 of the fingerboard side 112 of each nut saddle 104 establishes the action height 54 of a respective string with respect to the fingerboard 26, at the nut end of the string. The action height 54 at the nut end of a particular string 38, 40, etc., may be adjusted, if desired, by exchanging the associated nut saddle 104 for one whose fingerboard side 112 has a different height 116.

Figure 18:
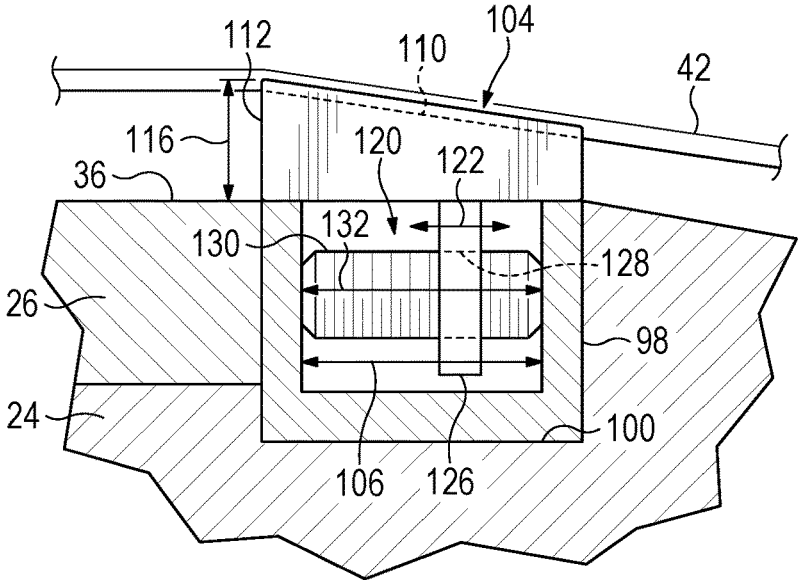
FIG. 18 is a sectional view taken along line 18-18 in FIG. 14, at an enlarged scale.
Figure 19:
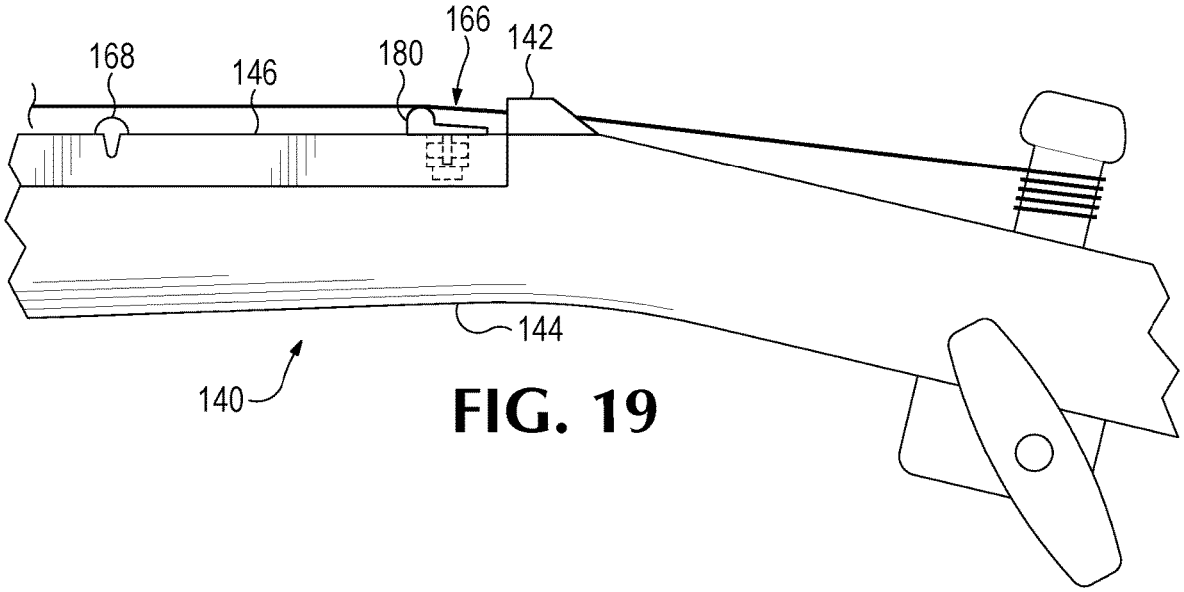
FIG. 19 is a side elevational view of a portion of the outer end of the neck of a guitar including an intonation mechanism including an aspect of the present invention.
Figure 20:
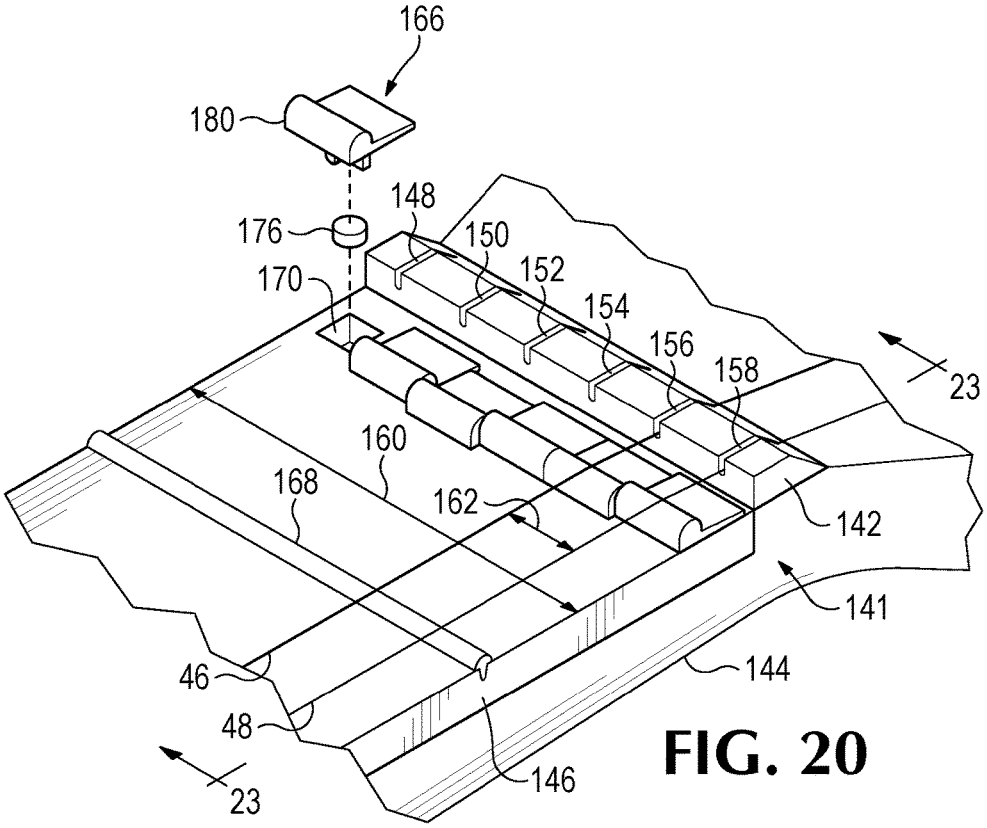
FIG. 20 is an isometric view similar to FIG. 14, showing the portion of a neck of a guitar shown in FIG. 19, including an arrangement by which the strings of the guitar are located at a desired spacing between strings and at a desired string height above a fingerboard, by use of adjustable string bearers, some of which are shown exploded away from the neck of the instrument.

Each nut saddle 104 includes a position adjustment mechanism 120, shown in FIGS. 16 and 18, by which the position of the individual nut saddle 104 with respect to the nut base member 98 may be adjusted in the direction of the arrow 122. The location of each nut saddle 104 thus may be adjusted toward or away from the bridge 32, parallel with the length 106 of the respective nut saddle receptacle 102, as shown best in FIG. 18. The position adjusting mechanism 120 includes a bracket 124, attached to the bottom 114 of the respective nut saddle 104. The bracket 124 may be inset in the bottom 114 of the respective nut saddle and attached by, for example, an adhesive. The bracket 124 includes a depending member 126 in which there is a threaded hole 128 that extends parallel with the bottom surface 114 of the nut saddle 104 and in a plane that is perpendicular to the bottom surface 114 of the nut saddle 104 and includes the string receiving groove 110. A saddle adjusting screw 130 is engaged in the threaded hole 128 and preferably has a length 132 equal to the length 106 of the respective nut saddle receptacle 102, so that the position of the saddle adjusting screw 130 in the depending member 126 establishes the position of the fingerboard side 112 of the nut saddle 104 in the direction of the arrow 122, with respect to the nut base member 98.

The open length of each string 38, 40, etc., may be adjusted at its nut end by loosening the string enough to lift the string from the nut saddle and move it aside far enough to create clearance for the respective nut saddle 104 to be removed from its receptacle 102 in the nut base member 98. The position of the nut saddle 104 with respect to the nut base member 98 can be changed in the direction of the arrow 122 by adjusting the screw 130 in the depending member 126, as suggested by FIG. 16. When the nut saddle 104 is returned to its receptacle 102 in the nut base member 98 the nut saddle 104 will be in an adjusted position, with its fingerboard side 112 moved toward or away from the bridge 32.

Once a stringed instrument such as the guitar 20 is initially set up, perhaps by adjustment of the angle of the neck 24 with respect to the body 22, and strings are installed, the intonation can be adjusted using the adjustable bridge 32 and adjustable nut 34 as described above to optimize the intonation of each string separately. The intonation of an instrument equipped with the adjustable bridge 32 and adjustable nut 34 may be adjusted to accommodate different strings or to optimize the sound of the instrument if it is to be played in a different style, but the appearance of the instrument remains very traditional, without the mechanical aspects of the bridge 32 or nut 34 being apparent without close inspection.

Referring now to FIGS. 19-25, in place of the adjustable nut 34 described above, a musical instrument such as a guitar 140 may be equipped with a nut assembly 141 including a slotted bracket 142 located at the outer end 144 of the neck, at the outer end of the fingerboard 146. The bracket 142 has a separate slot 148, 150, 152, 154, 156, or 158 for each string 38, 30, etc. and each slot is located with respect to the width 160 of the fingerboard and with respect to each adjacent slot 148, etc. at a position that may be designed and determined by the instrument maker, but that may be chosen according to preferences of a person purchasing the instrument. The bracket 142 installed in the instrument 140 determines the location of each individual string specifically with respect to the width 160 of the outer end 144 of the neck of the instrument 140 and also establishes the lateral distances 162, 164, etc. separating the strings 38, 40, etc. from one another.

Adjacent to the bracket 142, in the direction along the fingerboard 146 and toward the first fret 168 of the instrument, individual adjustable string-bearers 166 may be provided. Each string-bearer 166 is somewhat similar to one of the nut saddles 105 described above, in that each string bearer 166 is adjustable to establish its position along the fingerboard or away from the bridge in a process of optimizing the intonation of a particular string of the instrument. Separate string bearer receptacles 170 in the form of cavities similar to the nut saddle receptacles 102 may be defined alongside each other in the fingerboard 146 to receive respective ones of the string-bearers 166 to support the strings 38, 40, etc. Each such string bearer receptacle 170 has a respective length 172 parallel with the length of the neck 24, and a width 174 in a direction transverse of the neck 35. A small magnet 176 is preferably mounted securely in the bottom of each receptacle 170, to keep a respective string bearer in place. Instead of separate string bearer receptacles 170 a unitary channel may be provided, as will be understood.

In a musical instrument such as a guitar 140 being newly built, in which there never was a conventional non-adjustable nut, the receptacles 170 may be formed in the fingerboard 146 itself to accommodate the several string-bearers 166. In retrofitting an instrument originally provided with a conventional nut, a base member 208 may be fitted in a conventional transversely-extending channel 210 defined in the neck 144, at the outer end of the fingerboard 146, where a conventional non-adjustable nut ordinarily would be located. As with the nut base member 98 described above, a base member 208 preferably defines receptacles, equivalent to the receptacles 170, to receive the string bearers 166.

As shown in FIGS. 21-23, each string bearer 166 may be tapered, increasing in height in the direction from the bracket toward the bridge, with a fingerboard side 180 of the string bearer 166, located closer to the fingerboard 146 and the bridge 32, being highest and preferably defining a transverse ridge 182. A string 38 or 40, etc., in tension and supported by the string bearer 166 thus presses firmly against the ridge 182 at the fingerboard side 180 of the string-bearer 166 so that the ridge 182 defines the outer or nut end of the vibrating portion of the open length of the particular string 38 or 40, etc. that is available to be tuned to a desired fundamental frequency of the string.

Similar to the nut saddles 104, each string bearer 166 has a bottom surface 184, seen in FIG. 22, that rests against the generally planar top surface 186 of the fingerboard 146 defining the periphery of each of the receptacles. The height 188 of the ridge 182 at the fingerboard side 180 of each string bearer 166 also establishes the action height 54 of a respective string, with respect to the fingerboard 146, at the nut end of the string. The action height 54 at the nut end of a particular string 38, 40, etc., may be adjusted, if desired, by exchanging the string bearer 166 associated with a particular string for one whose ridge 182 has the desired height 188 above the bottom surface 184 to establish the desired action height 54 for that string. For that reason a luthier may make sets of string bearers similar except for the height of each above its bottom surface.

Each string bearer 166 includes a position adjustment mechanism 190 essentially similar to the position adjustment 120 shown in FIGS. 16 and 18, by which the position of the individual string bearer 166 may be adjusted with respect to the fingerboard 146 and the first fret 168 in the direction of the arrow 192. The location of each string bearer 166 thus may be adjusted toward or away from the first fret 168, moving the ridge 182 in a direction parallel with the length 172 of the respective receptacle 170, as shown best in FIG. 23. The position adjusting mechanism 190 includes a bracket 194, attached to the bottom 184 of the respective string bearer 166. The bracket 194 may be inset in the bottom 184 of the respective string bearer 166 and attached by, for example, an adhesive. The bracket 194 includes a depending member 196 in which there is a threaded bore 198 that extends parallel with the bottom surface 184 of the string bearer 166 and the length of the neck 144 and is centrally located with respect to the width of the string bearer 166.

A string bearer adjusting screw 200 is engaged in the threaded hole 198 and preferably has a length 202 equal to the length 172 of the respective receptacle 170, so that the position of the saddle adjusting screw 200 in the depending member 196 establishes the position of the top of the ridge 182 in the direction of the arrow 192, with respect to the fingerboard 146. The adjusting screw 200 or the bracket 194 or both may be of ferromagnetic material, so that the magnet 176 will retain the string bearer in place in the receptacle 170 even when a string is not pressing on the ridge 182. Once the string bearer 166 is in place in its receptacle 170, it will not fall out when string tension is removed, as when replacing a deteriorated or broken string. Assuming that a string that may need replacement is replaced with a similar string, then, a desired intonation of a string, previously achieved through iterative adjustments, will not need to be revised.

The open length of each string 38, 40, etc., may be adjusted at its nut end by loosening the string enough to move it aside far enough to permit the respective string bearer 166 to be removed from its receptacle 170 in the fingerboard 146. The position of the string bearer 166 with respect to the fingerboard 146 can be changed in the direction of the arrow 192 by adjusting the screw 200 in the depending member 196, as suggested by FIG. 22. When the nut saddle 104 is returned to its receptacle 170 in the fingerboard 146 it will be in an adjusted position, with its fingerboard side 180 and ridge 182 moved toward or away from the bridge.

The string bearers 166 or nut saddles 104 may be of bone or hardwood, giving a traditional appearance, since the adjustment mechanisms 120 and 190 are concealed within the receptacles of the nut base or the fingerboard material. The string bearers 166 or nut saddles 104 may, instead, be manufactured of a suitably strong and hard polymer or reinforced polymer material of a desired color to provide an ornamental appearance at the outer end of the neck of a guitar.

A guitar or other stringed musical instrument with a fretted fingerboard provided with the adjustable bridge 32 and the adjustable nut 34 or the slotted bracket 142 and adjustably located string bearers 166 as described above can be set up to locate each string in a desired location with respect to the width 160 of the fingerboard 146, and to provide optimum accuracy of intonation for each string, by utilizing the adjustable components described above in carrying out a setting-up procedure according to some or all of the following steps.

First, with a set of strings 38, 40, etc. installed and extending between the bridge 32 and the adjustable nut 34 or the nut assembly 141 described above, the strings may be tuned preliminarily to their intended fundamental tones, and the angle 37, at which the neck 144 extends from the body 22, may be adjusted so that the action height 54 is appropriately consistent along the entire fingerboard 26 or 146.

Initially, each of the nut saddles 104 or string bearers 166 installed should provide a string height, at its fingerboard side 112 or ridge 182, that is substantially conventional, such as the string height provided by a conventional nut. Once the angle 37 has been determined to be satisfactory, a different set of nut saddles 104 or string bearers 166 may be installed at the nut end of the neck 24 or 144 to provide a desired action height 54, and strings of a type intended to be used with the instrument should be installed.

Figure 24:
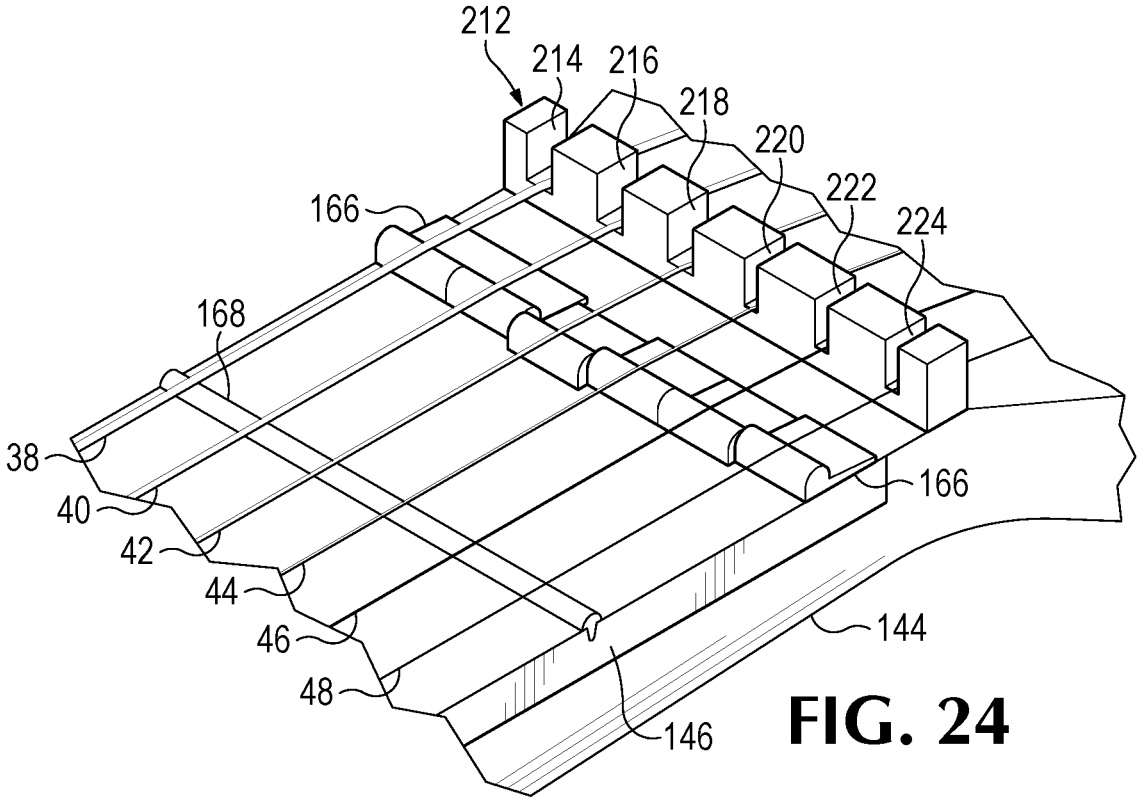
FIG. 24 is an isometric view of an outer end portion of a neck of a multi-string musical instrument, with a trial bracket installed.
Figure 25:
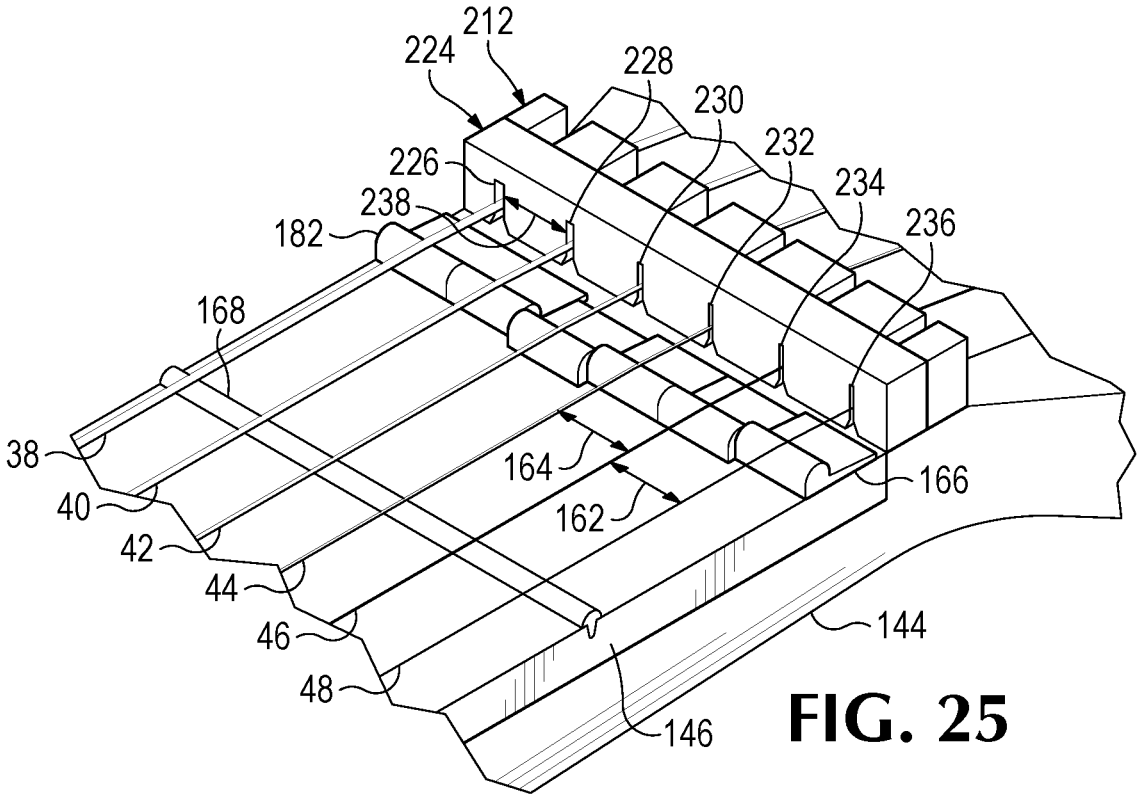
FIG. 25 is a view similar to that of FIG. 24, also including a trial comb in place alongside and cooperating with the trial bracket.

In setting up a guitar for a particular musician a conventional string location and spacing with respect to the neck may be utilized initially, but if the musician desires to modify the string spacing to a personal preference, a temporary trial bracket 212 may be utilized to help determine an optimum string spacing. As shown in FIG. 24, such a temporary trial bracket 212 includes wide string slots 212, 214, 216, 218, 220, and 222 to hold each string of the instrument individually, but the wide slots are too wide to retain a string in a specific position with respect to the width 160 of the fingerboard 146. Particular string positions can be established definitely, for trial purposes, by mating a set-up comb 224 with the trial bracket 212 in space available on the neck 144 between the temporary set up bracket 212 and the string bearers 166. The trial comb 224 has respective slots 226, 228, 230, 232, 234, and 236. Each of those slots has an appropriate width to hold a respective one of the strings of the instrument at a specific location with respect to the width 160 of the neck 146 and thus to establish a particular separation distance 238 between each string 38, 40, etc. and the next adjacent string.

Figure 26:
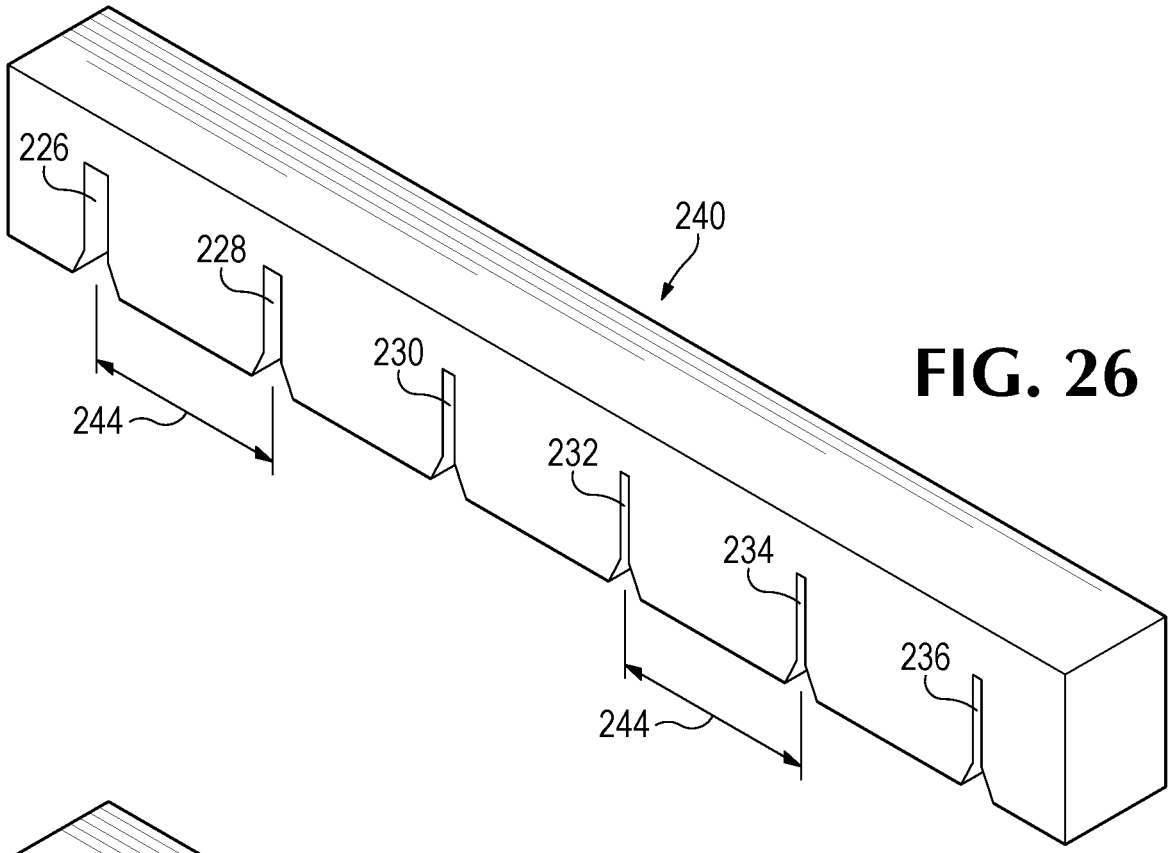
FIG. 26 is an isometric view of a trial comb similar to the one shown in FIG. 25.
Figure 27:
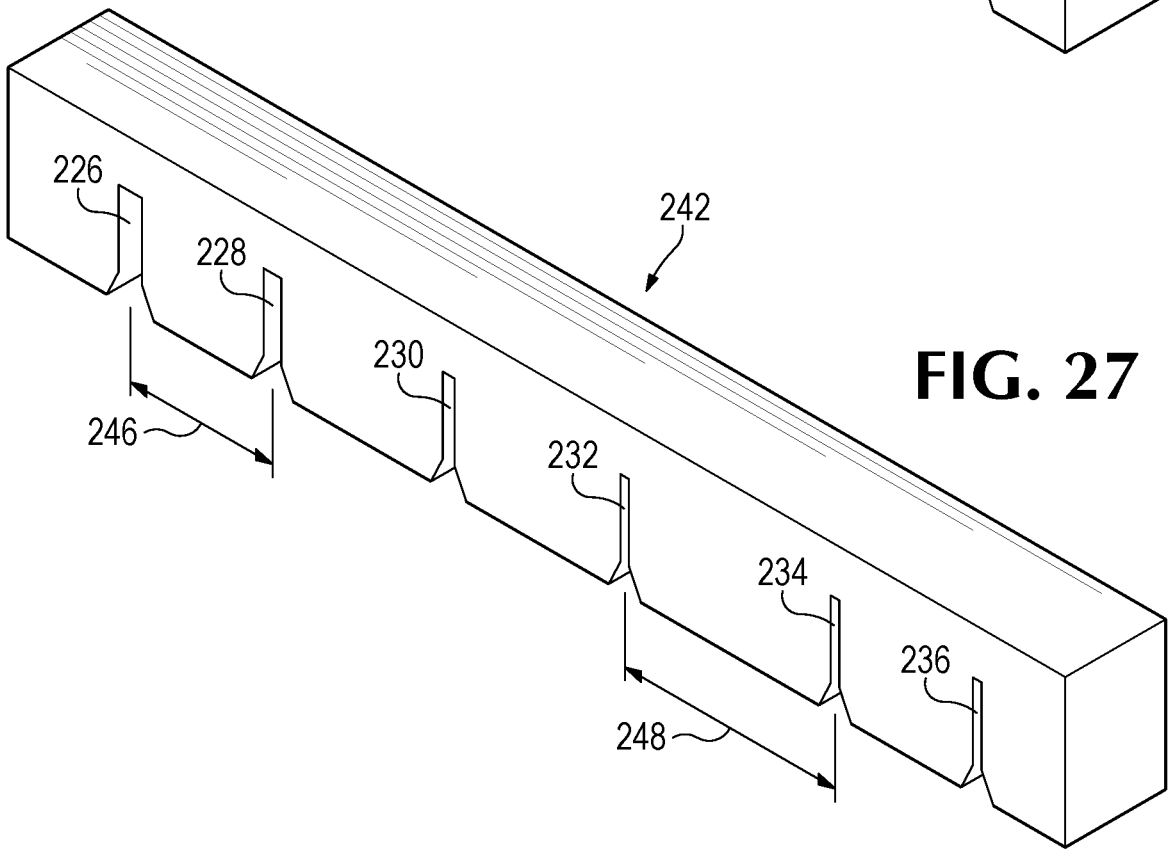
FIG. 27 is an isometric view of a trial comb shaped to provide a different string spacing from that available by use of the trial comb shown in FIG. 26.

The different trial combs 240 and 242, shown in FIGS. 26 and 27, for example, may provide different string separation distances. Depending on a musician's preferences, a uniform separation distance 244 may be provided between any two adjacent strings 38, 40, etc. of a multi-stringed instrument such as a guitar, as shown on the set-up trial comb 240. Alternatively, a trial set-up comb 242 may provide different center-to-center spacings 246 and 248 between adjacent strings, as, for example, providing a spacing 246 between the lower-pitch strings that is greater than the spacing 248 between the higher-pitch strings, if that is what a particular musician might prefer. Because the string bearers 166 have ridges 182 but no grooves such as the string grooves 110 in the nut saddles 104, different string locations and spacings are freely accommodated by the string bearers 166.

A musician can play the instrument using the temporary set-up bracket 212 in combination with successive ones of an assortment of set-up trial combs 224, 240, 242, or others not shown, and select desired string spacings and locations, after which a permanent bracket 142, with slots 148, 150, 152, 154, 156, and 158 fitting the strings closely and providing the selected specific string spacing and location, may be installed on the instrument.

Next, the intonation of each string can be optimized. With the adjustable nut saddles 104 or the adjustable string-bearers 166 adjusted to a position providing the usual distance between the first fret 20 and the fingerboard side 112 or 180 of each adjustable nut saddle 104 or string-bearer 166, the bridge string saddle element 64 for each string should be placed in a position for the bridge end of the string establishing the length of the string that results in a minimum intonation error when the string is fretted on each of the frets of the fingerboard.

Once that has been accomplished, the positions of the nut saddles 104 or string-bearers 166 may be adjusted with respect to the first fret 28 or 168 so that the first fret provides an accurate halftone increase in pitch from the fundamental frequency of each tuned, open, string.

The procedure with respect to adjusting the positions of the nut saddles 104 or string bearers 166 and the bridge string saddle elements 64 may then be repeated one or more times to establish the optimal positions of the bridge string saddle elements 64 and the nut saddles 104 or string bearers 164 for all of the strings 38, 40, etc.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. An intonation system for a musical instrument having a plurality of strings, a bridge mounted on a tone body, and a neck extending away from the tone body and having a length, a width, and an outer end, the intonation system comprising:

(a) a slotted bracket mounted at the outer end of the neck, the slotted bracket defining a plurality of slots, each slot receiving a respective one of the plurality of strings and being located to establish a respective position with respect to the width of the neck for the respective one of the plurality of strings; and (b) a plurality of string bearers, each including a transverse ridge adapted to support one of the plurality of strings at a position along the ridge determined by a location of a respective one of the slots, and each string bearer including an adjustment mechanism arranged to interact with the neck to establish a respective selected position of adjustment within a range of potential positions along the length of the neck at the outer end of the neck, and to keep the string bearer in said selected position, with the transverse ridge included in each string bearer establishing a nut end of a vibrating length of a respective one of the strings at a location resulting from the selected position of adjustment.

2. The intonation system of claim 1, also including an adjustable bridge including a base member and a plurality of bridge saddle assemblies each including a bridge string saddle element defining a string-receiving groove, and wherein each bridge string saddle element is movable with respect to the base member through a range of potential positions, in a direction parallel with the length of the neck.

3. The intonation system of claim 2 wherein one of the bridge saddle assemblies includes a saddle base member defining a guide channel and wherein a respective bridge string saddle element is mated with the saddle base member and is movable with respect to the saddle base member in a direction established by the guide channel, through the range of potential positions.

4. The intonation system of claim 3, wherein the guide channel defined by a saddle base member is a T-slot and wherein the respective bridge string saddle element includes a lower portion mated in the T-slot and arranged to maintain a directional orientation of the respective bridge string saddle element with respect to the saddle base member with which it is mated.

5. The intonation system of claim 1 wherein each string bearer has a bottom surface resting on an upper surface of the neck and wherein the transverse ridge of each string bearer has a string support height above the bottom surface, and wherein each string bearer is selected from among a plurality of interchangeable string bearers of which the transverse ridge of each has a different string support height.

6. The intonation system of claim 1 wherein the adjustment mechanism of each string bearer includes a depending member extending into a respective string bearer receptacle at the outer end of the neck.

7. An intonation system for a multi-stringed musical instrument having a bridge mounted on a tone body and a neck extending away from the tone body and having a length, a width, and an outer end, comprising:

(a) a slotted bracket mounted at the outer end of the neck, the slotted bracket defining a plurality of slots, each establishing a respective position with respect to the width of the neck for one of a plurality of strings;

(b) a plurality of string bearers each including a string-bearing transverse ridge and an adjustment mechanism arranged to interact with the neck to keep each string bearer in a selected position of adjustment in a direction parallel with the length of the neck and within a range of potential positions with respect to the outer end of the neck, each string bearer thus establishing a nut end of a vibrating length of a respective one of the strings;

(c) an adjustable bridge including a base member and a plurality of bridge saddle assemblies each including a bridge string saddle element defining a string-receiving groove, each bridge string saddle element being movable with respect to the base member through a range of potential positions, in a direction parallel with the length of the neck, one of the bridge saddle assemblies including a saddle base member defining a guide channel and a respective bridge string saddle element being mated with the saddle base member and being movable with respect to the saddle base member in a direction established by the guide channel, through the range of potential positions, and wherein the guide channel defined by a saddle base member is a T-slot, and wherein the respective bridge string saddle element includes a lower portion mated in the T-slot and arranged to maintain a directional orientation of the respective bridge string saddle element with respect to the saddle base member with which it is mated; and wherein (d) the lower portion of the bridge string saddle element includes a depending web and a pair of flanges extending away from the web and engaged in the T-slot, the flanges each having a bottom face and a limited amount of clearance in a direction normal to the bottom face, and wherein the bridge string saddle assembly includes a layer of a frictional material, between the bottom face and an opposing interior surface of the T-slot, and wherein a string of the stringed instrument, when supported by the one of the bridge string saddle assemblies, urges the bottom face of each of the flanges and the layer of frictional material against the opposing interior surface of the T-slot, thus keeping the respective bridge string saddle element from moving with respect to the saddle base member with which it is mated.

8. An intonation system for a multi-stringed musical instrument having a bridge mounted on a tone body and a neck extending away from the tone body and having a length, a width, and an outer end, comprising:

(a) a slotted bracket mounted at the outer end of the neck, the slotted bracket defining a plurality of slots, each establishing a respective position with respect to the width of the neck for one of a plurality of strings;

(b) a plurality of string bearers each including a string-bearing transverse ridge and an adjustment mechanism arranged to interact with the neck to keep each string bearer in a selected position of adjustment in a direction parallel with the length of the neck and within a range of potential positions with respect to the outer end of the neck, each string bearer thus establishing a nut end of a vibrating length of a respective one of the strings;

(c) an adjustable bridge including a base member and a plurality of bridge saddle assemblies each including a bridge string saddle element defining a string-receiving groove, each bridge string saddle element being movable with respect to the base member through a range of potential positions, in a direction parallel with the length of the neck, one of the bridge saddle assemblies including a saddle base member defining a guide channel and a respective bridge string saddle element being mated with the saddle base member and being movable with respect to the saddle base member in a direction established by the guide channel, through the range of potential positions, and wherein the guide channel defined by a saddle base member is a T-slot, and wherein the respective bridge string saddle element includes a lower portion mated in the T-slot and arranged to maintain a directional orientation of the respective bridge string saddle element with respect to the saddle base member with which it is mated, and wherein (d) the respective bridge string saddle element includes a spring, carried on a portion of the bridge string saddle element that is located within the guide channel, the spring being arranged to make the bridge string saddle element rise to a position of clearance above a bottom of the guide channel and to keep the string saddle from being so loose that it can slide freely in the guide.

9. An intonation system for a multi-stringed musical instrument having a bridge mounted on a tone body and a neck extending away from the tone body and having a length, a width, and an outer end, comprising:

(a) a slotted bracket mounted at the outer end of the neck, the slotted bracket defining a plurality of slots, each establishing a respective position with respect to the width of the neck for one of a plurality of strings; and (b) a plurality of string bearers each including a string-bearing transverse ridge and an adjustment mechanism arranged to interact with the neck to keep each string bearer in a selected position of adjustment in a direction parallel with the length of the neck and within a range of potential positions with respect to the outer end of the neck, each string bearer thus establishing a nut end of a vibrating length of a respective one of the strings; and (c) an adjustable bridge including a base member and a plurality of bride saddle assemblies each including a bridge string saddle element defining a string-receiving groove, wherein each bridge string saddle element is movable with respect to the base member through a range of potential positions, in a direction parallel with the length of the neck; and wherein (d) the base member of the adjustable bridge defines a saddle receptacle cavity, one of the bridge string saddle assemblies being located in the saddle receptacle cavity, and including in the adjustable bridge a shim located within the saddle receptacle cavity beneath the one of the bridge string saddle assemblies, thereby supporting the one of the bridge string saddle assemblies at a selected height with respect to the body of the stringed musical instrument.

10. A stringed musical instrument including an intonation adjustment system, the musical instrument comprising:

(a) a body;

(b) a neck extending from the body;

(c) a fingerboard extending along the neck and having an outer end;

(d) a bridge mounted on the body;

(e) an adjustable nut assembly located at the outer end of the fingerboard; and (f) a plurality of strings extending from the bridge and along the fingerboard to the nut assembly; and wherein (g) the nut assembly includes:

(i) a plurality of string bearers and a slotted bracket mounted on the neck, each string bearer having a string-bearing transverse ridge and each string bearer including an adjustment mechanism arranged to interact with the neck to keep each string bearer in a respective position of adjustment, within an available range of potential positions in a direction toward or away from the bridge and wherein each string rests on the transverse ridge of a respective string bearer and the transverse ridge of each string bearer thus establishes a nut end of a vibrating length of the respective one of the plurality of strings; and wherein (ii) the slotted bracket is adjacent to the string bearers but further than the string bearers from the bridge, and the slotted bracket defines a plurality of slots, each slot establishing a location with respect to the width of the neck and thus along the transverse ridge of a respective one of the string bearers, for a respective one of the strings.

11. The stringed musical instrument of claim 10 wherein the bridge includes a bridge base member and a plurality of separate bridge saddle assemblies mounted in the bridge base member, each bridge saddle assembly including a bridge string saddle element that is movable within an available range of potential positions with respect to the bridge base member, in a direction toward or away from the nut assembly, and wherein each bridge string saddle element thus establishes a bridge end of the vibrating length of a respective one of the plurality of strings.

12. The stringed musical instrument of claim 11 wherein one of the saddle assemblies includes a saddle base member defining a guide channel and wherein a respective string saddle element is mated with the saddle base member and is movable with respect to the saddle base member in a direction established by the guide channel, through an available range of potential positions.

13. The stringed musical instrument of claim 12, wherein the guide channel defined by a saddle base member is a T-slot and wherein the respective string saddle element includes a lower portion mated in the T-slot and arranged to maintain a directional orientation of the respective bridge string saddle element with respect to the saddle base member with which it is mated.

14. The stringed musical instrument of claim 10 wherein each string bearer has a bottom surface resting on an upper surface of the neck and wherein the string-bearing transverse ridge has a string support height above the bottom surface, and wherein each string bearer is selected from among a plurality of interchangeable string bearers each of which has a different string support height.

15. A stringed musical instrument including an intonation adjustment system, the musical instrument comprising:

(a) a body;

(b) a neck extending from the body;

(c) a fingerboard extending along the neck and having an outer end;

(d) a bridge mounted on the body;

(e) a nut assembly located at the outer end of the fingerboard; and (f) a plurality of strings extending from the bridge and along the fingerboard to the nut assembly; and wherein (g) the nut assembly includes a plurality of string bearers each having a string-bearing transverse ridge and each including an adjustment mechanism arranged to interact with the neck to keep each string bearer in a respective position of adjustment, within an available range of potential positions in a direction toward or away from the bridge and wherein each string bearer thus establishes a nut end of a vibrating length of the respective one of the plurality of strings;

wherein the bridge includes a bridge base member and a plurality of separate bridge saddle assemblies mounted in the bridge base member, each bridge saddle assembly including a bridge string saddle element that is movable within an available range of potential positions with respect to the bridge base member, in a direction toward or away from the nut assembly, and wherein each bridge string saddle element thus establishes a bridge end of a vibrating length of a respective one of the plurality of strings;

wherein one of the saddle assemblies includes a saddle base member defining a guide channel and wherein a respective string saddle element is mated with the saddle base member and is movable with respect to the saddle base member in a direction established by the guide channel, through an available range of potential positions;

wherein the guide channel defined by a saddle base member is a T-slot and wherein the respective string saddle element includes a lower portion mated in the T-slot and arranged to maintain a directional orientation of the respective bridge string saddle element with respect to the saddle base member with which it is mated; and wherein the lower portion of the string saddle element includes a depending web and a pair of flanges extending away from the web and engaged in the T-slot, the flanges each having a bottom face and a limited amount of clearance in a direction normal to the bottom face, and wherein the one of the bridge string saddle assemblies includes a layer of a frictional material between the bottom face and an opposing interior surface of the T-slot, and wherein a string of the stringed instrument, when supported by the respective string saddle element, urges the bottom face of each of the flanges against the opposing interior surface of the T-slot, thus keeping the respective string saddle element from moving with respect to the saddle base member with which it is mated.

16. A stringed musical instrument including an intonation adjustment system, the musical instrument comprising:

(a) a body;

(b) a neck extending from the body;

(c) a fingerboard extending along the neck and having an outer end;

(d) a bridge mounted on the body;

(e) a nut assembly located at the outer end of the fingerboard; and (f) a plurality of strings extending from the bride and along the fingerboard to the nut assembly; and wherein (g) the nut assembly includes a plurality of string bearers each having a string-bearing transverse ridge and each including an adjustment mechanism arranged to interact with the neck to keep each string bearer in a respective position of adjustment, within an available range of potential positions in a direction toward or away from the bridge and wherein each string bearer thus establishes a nut end of a vibrating length of a respective one of the plurality of strings;

wherein the bridge includes a bridge base member and a plurality of separate bridge saddle assemblies mounted in the bridge base member, each bridge saddle assembly including a bridge string saddle element that is movable within an available range of potential positions with respect to the bridge base member, in a direction toward or away from the nut assembly, and wherein each bridge string saddle element thus establishes a bridge end of a vibrating length of a respective one of the plurality of strings;

wherein one of the saddle assemblies includes a saddle base member defining a guide channel and wherein a respective string saddle element is mated with the saddle base member and is movable with respect to the saddle base member in a direction established by the guide channel, through an available range of potential positions;

wherein the guide channel defined by a saddle base member is a T-slot, and wherein the respective string saddle element includes a lower portion mated in the T-slot and arranged to maintain a directional orientation of the respective bridge string saddle element with respect to the saddle base member with which it is mated; and wherein the respective bridge string saddle element includes a spring carried on a portion of the bridge string saddle element that is located within the guide channel, the spring being arranged to make the bridge string saddle element rise to a position of clearance above a bottom of the guide channel and to keep the bridge string saddle from being so loose that it can slide freely in the guide.

17. A method of setting up a multi-stringed instrument having an adjustable bridge and a neck including an adjustable nut assembly and a fingerboard having frets spaced apart from one another along the fingerboard toward the adjustable bridge, from a first fret adjacent an outer end of the neck, comprising:

(a) tuning each of a plurality of strings to a respective fundamental frequency;

(b) thereafter determining an amount of error in a tone of one of the plurality of strings when fretted on a fret other than the first fret;

(c) thereafter adjusting the length of that one of the plurality of strings by adjusting the bridge so as to reduce the amount of error in the tone of that string when fretted on the fret other than the first fret;

(d) thereafter, again tuning that one of the plurality of strings to its respective fundamental frequency and then determining an amount of error in tone when fretting that string on the first fret;

(e) thereafter, adjusting the length of that one of the plurality of strings by adjusting the nut assembly with respect to only that string, thereby reducing the amount of error in tone when fretting that string on the first fret;

(f) thereafter, repeating steps (b) through (e) with respect to each other one of the plurality of strings.

18. The method of claim 17, including, prior to the step of tuning each of the plurality of strings to a respective fundamental frequency, mounting a slotted bracket on the outer end of the neck, as a part of the adjustable nut assembly, at a location farther from the adjustable bridge than a plurality of string-supporting members of the adjustable nut assembly that determine respective nut ends of respective vibrating lengths of the plurality of strings, extending each of the plurality of strings through a respective slot defined in the bracket, and thereby placing a nut end of each of the plurality of strings at a respective desired location with respect to a width of the fingerboard.

19. The method of claim 17 including adjusting the adjustable bridge to establish a desired height of the one of the plurality of strings at the adjustable bridge.

20. The method of claim 17 including replacing a string bearer or a nut saddle in the adjustable nut assembly with a string bearer or a nut saddle having a height different from that of the replaced string bearer or nut saddle and thereby establishing a desired height of a respective one of the plurality of strings at the outer end of the neck.

21. The method of claim 17 including improving intonation of the instrument by repeating all of steps (a) through (f).

22. A method of setting up a multi-stringed musical instrument having a body and a neck extending away from the body, the neck having a length and a width and an outer end and a nut assembly establishing respective locations of the plurality of strings with respect to the width of the neck at the outer end of the neck to suit a preference of a musician, the method comprising:

(a) fastening a temporary set-up bracket defining a plurality of wide slots to the outer end of the neck, each wide slot being located at a respective approximate location with respect to the width of the neck and being wide enough to receive a single respective one of the strings of the instrument and too wide to establish a precise location of a string with respect to the width of the neck;

(b) installing a set of strings on the instrument with each one of the set of strings extending through a respective wide slot of the temporary set-up bracket;

(c) providing a plurality of trial combs, each including a plurality of slots each of which is of a size to snugly hold and definitely locate a single string at a predetermined precise location within a respective one of the wide slots of the temporary set-up bracket and thus to definitely locate each of the set of strings at a predetermined location with respect to the width of the neck and with respect to each other one of the set of strings;

(d) installing a first one of the trial combs in a cooperating position with respect to the temporary set-up bracket so that the first one of the trial combs establishes a precise location of each one of the set of strings with respect to the width of the neck, and then playing the instrument with the first one of the trial combs installed;

(e) thereafter, replacing the first one of the trial combs with at least one of the other ones of the trial combs so that the at least one of the other ones of the trial combs establishes a precise location of each one of the set of strings, and then playing the instrument with each of the at least one of the other ones of the trial combs installed, in turn;

(f) from the experience of playing the instrument with each of the first one and at least one other one of the plurality of trial combs, determining a preferred string placement with respect to the width of the neck;

(g) thereafter, removing a final one of the other trial combs and the temporary set-up bracket and installing on the outer end of the neck a permanent string bracket including a set of string-locating slots located with respect to the outer end of the neck to provide the preferred precise location of each of the set of strings with respect to the width of the neck and to provide the preferred spacing between adjacent strings, as determined by playing the instrument with the at least two different trial combs in cooperation with the temporary set-up bracket.

23. An intonation system for a musical instrument having a plurality of strings, a bridge mounted on a tone body, and a neck extending away from the tone body and having a length, a width, and an outer end, the intonation system comprising:

(a) a plurality of string bearers located at the outer end of the neck, each including a string-bearing ridge extending transversely with respect to the neck and each including an adjustment mechanism arranged to interact with the neck to establish and maintain a selected position of the string bearer, within a range of potential positions along the length of the neck, the respective string-bearing ridge of each string bearer thus establishing a nut end of a vibrating length of a respective one of the strings;

(b) a respective quantity of magnetic material included in each string bearer; and (c) a plurality of magnets mounted at the outer end of the neck, in respective positions where each of the plurality of magnets can retain a respective one of the string bearers on the neck in the selected position for that string bearer.

* * * * *